US006756329B1

(12) United States Patent
Umino et al.

(10) Patent No.: US 6,756,329 B1
(45) Date of Patent: Jun. 29, 2004

(54) SYNTHETIC FIBER CAPABLE OF ABSORBING AND DISABSORBING MOISTURE, ENTANGLED YARN BLEND USING THE SAME, KNITTED AND WOVEN GOODS USING THE SAME, AND NONWOVEN FABRIC USING THE SAME

(75) Inventors: Mitsuhiro Umino, Uji (JP); Kunio Akasaki, Uji (JP); Yoshiaki Kurushima, Uji (JP); Kazuyuki Ono, Uji (JP); Hajime Yamaguchi, Uji (JP); Shigemitsu Murase, Uji (JP); Shiro Murakami, Uji (JP); Kuzuaki Taruishi, Uji (JP)

(73) Assignee: Unitika Ltd. (JP)

( * ) Notice: Subject to any disclaimer, the term of this patent is extended or adjusted under 35 U.S.C. 154(b) by 0 days.

(21) Appl. No.: 09/646,559

(22) PCT Filed: Mar. 23, 1999

(86) PCT No.: PCT/JP99/01460

§ 371 (c)(1),
(2), (4) Date: Sep. 19, 2000

(87) PCT Pub. No.: WO99/49111

PCT Pub. Date: Sep. 30, 1999

(30) Foreign Application Priority Data

Mar. 24, 1998 (JP) ..... 10-075275
Mar. 24, 1998 (JP) ..... 10-075276
Apr. 3, 1998 (JP) ..... 10-091212

(51) Int. Cl.[7] ..... D03D 25/00; D04M 1/00

(52) U.S. Cl. ..... 442/181; 442/364; 57/243; 57/244; 57/908; 57/246

(58) Field of Search ..... 442/364; 57/243, 57/244, 968, 246

(56) References Cited

U.S. PATENT DOCUMENTS 4,767,825 A * 8/1988 Pazos et al. ..... 525/408
6,105,224 A * 8/2000 O'Mara, Jr. et al. ..... 28/271

FOREIGN PATENT DOCUMENTS

| | | | |
|---|---|---|---|
| JP | 04108114 | A | 4/1992 |
| JP | 07097718 | A | 4/1995 |
| JP | 08209450 | A | 8/1996 |
| JP | 09188917 | A | 7/1997 |
| JP | 09228216 | A | 9/1997 |
| JP | 09291429 | A | 11/1997 |

OTHER PUBLICATIONS

Introductory Textile Science, 5$^{th}$ Edition, Marjory L. Joseph, CBS College Publishing, p. 199.*

* cited by examiner

*Primary Examiner*—Terrel Morris
*Assistant Examiner*—Alexis Wachtel
(74) *Attorney, Agent, or Firm*—Harness, Dickey & Pierce, P.L.C.

(57) ABSTRACT

A synthetic fiber capable of absorbing and disabsorbing moisture comprising a component capable of absorbing and disabsorbing moisture and a fiber-forming polymer. The fiber of the present invention has a moisture absorption of 1.5% or more when it is allowed to reach a moisture equilibrium under the circumstance of 25° C.×60%RH and then is allowed to stand for 30 min. under the circumstance of 34° C.×90%RH, and has a moisture disabsorption of 2% or more when it is allowed to reach a moisture equilibrium under the circumstance of 34° C.×90%RH and then is allowed to stand for 30 min. under the circumstance of 25° C.×60%RH. The fiber also has a value of −1 to 5 in terms of b value in the CIE-LAB color system when it is allowed to stand for 30 days.

15 Claims, No Drawings

SYNTHETIC FIBER CAPABLE OF ABSORBING AND DISABSORBING MOISTURE, ENTANGLED YARN BLEND USING THE SAME, KNITTED AND WOVEN GOODS USING THE SAME, AND NONWOVEN FABRIC USING THE SAME

FIELD OF THE INVENTION

The present invention relates to a synthetic fiber capable of absorbing and disabsorbing moisture, entangled and mixed yarn using the same, knitted and woven fabrics using the same, and the transparency of nonwoven fabric using the same.

BACKGROUND OF THE INVENTION

Synthetic fiber is superior to natural fiber such as cotton in the property of tensile strength, abrasion resistance, dimensional stability, a quick drying, and broadly used in the field of clothing material. However, synthetic fiber does not have the superior moisture absorption as in natural fiber, and by perspiration in wearing, there occur over humidity and tackiness to skin, resulting in poorer comfortable wearing than natural fiber.

On this account a lot of trials in various ways have been carried out to give moisture absorption and water absorption to synthetic fiber. For example, a moisture absorbing fiber, having a value of equal to or more than 2.5% or 1.5%, respectively, in terms of ΔMR using polyetherester amide as moisture absorbing component, is disclosed in JP-A-9-41204 or JP-A-9-41221. ΔMR is a difference between moisture content of fiber allowed to stand in the atmosphere of 30° C.×90%RH for 24 hours and moisture content of fiber allowed to stand in the atmosphere of 20° C.×65%RH for 24 hours, defined as a moisture absorbing and disabsorbing coefficient.

ΔMR is, however, a value which is calculated from moisture contents of the fiber after allowed to stand under different conditions of temperature and humidity for 24 hours. It is practically important for synthetic fiber to absorb or desorb moisture quickly when a condition of temperature and humidity has changed. However, JP-A-9-41204 or JP-A-9-41221 does not give any suggestion about this fact.

On the other hand, JP-A-63-227871, JP-A-63-227872, or the like suggest comfortable materials for apparel with a capability of absorbing and disabsorbing moisture, and also describe the moisture absorbing rate after 15 min. when the material is moved from the circumstance of 20° C.×65%RH to the circumstance of 30° C.×90%RH, and also the moisture disabsorbing rate after 15 min. when the material is moved from the circumstance of 30° C.×90%RH to the circumstance of 20° C.×65%RH. However, the technology mentioned in these document is related to moisture of a absorbing component to a surface of knitted and woven fabrics made of polyester or polyamide fiber by graft polymerization, and results in disadvantages such as harsh touch, and slippy touch, uneven dyeing, a marked reduction in color fastness upon wetting.

Moreover, in general, many of thermoplastic polymers with superior capability of moisture absorption and water absorption are originally colored or have a tendency of gradual coloring with time, resulting in deterioration of quality and grade of fiber goods. For example, a compound fiber with superior moisture absorbing and disabsorbing capability is disclosed in JP-A-8-209450, JP-A-8-311719 or the like. In these documents, modified polyethyleneoxide is used as a component with a moisture absorbing and disabsorbing capability to provide fiber with a superior moisture absorbing and disabsorbing. The documents, however, describe that diisocyanate compounds are used as a modifier for polyethyleneoxide, but they fail to give any suggestion that a change in color tone of fiber materials is successfully controlled. A modified polyethyleneoxide mentioned in examples (a product name: Aquacoke) is modified with aromatic diisocyanate compounds, and the fiber has a problem of gradual change in color tone.

In U.S. Pat. No. 4767825, a nonwoven fabric which is composed of a water absorbing polymer with polyoxymethylene soft segment and hard segment is suggested. This nonwoven fabric, however, is excellent in moisture absorbing and disabsorbing, a property of fiber and fiber-forming, but has a problem of color yellowing or of poor weather-resistance when used long.

A technical subject of the present invention is to provide a synthetic fiber with a superior moisture absorbing and disabsorbing capability, which exhibits a moisture absorption or desorption function according to the condition of temperature and humidity of atmosphere and can exhibit the moisture absorbing and disabsorbing function repeatedly with changes in temperature and humidity, which has less tendency toward a change in color tone, especially yellowing, in storage over a long period of time, which has no problems in touch or dyeability when used as clothing materials; entangled and mixed yarn, knitted and woven fabrics, and nonwoven fabric using the above mentioned synthetic fiber.

DISCLOSURE OF THE INVENTION

The present invention is achieved as a result of having studied zealously to solve above mentioned subjects.

A synthetic fiber capable of absorbing and disabsorbing moisture of the present invention comprising a component capable of absorbing and disabsorbing moisture component and a fiber-forming polymer has a moisture absorption of 1.5% or more when it is allowed to reach a moisture equilibrium under the circumstance of 25° C.×60%RH and then is allowed to stand for 30 min. under the circumstance of 34° C.×90%RH, and has a moisture disabsorption of 2% or more when it is allowed to reach a moisture equilibrium under the circumstance of 34° C.×90%RH and then is allowed to stand for 30 min. under the circumstance of 25° C.×60%RH. The fiber also has a value of −1 to 5 in terms of b value in the CIE-LAB color system when it is allowed to stand for 30 days.

In the entangled and mixed yarn of the present invention, the first fiber comprising the above described synthetic fiber capable of absorbing and disabsorbing moisture and the second fiber comprising a polyester fiber are entangled and blended. The above described yarn blend has a mixing weight ratio of (the first fiber)/(the second fiber)=20/80 to 80/20, and the first fiber has a higher boiling water shrinkage than the second fiber.

The knitted and woven fabrics of the present invention is principally constituted by the above mentioned entangled and mixed yarn.

The nonwoven fabric of the present invention is constituted by a synthetic fiber capable of absorbing and disabsorbing moisture having the structure of moisture absorbing and disabsorbing component located in the core and fiber-forming polymer located in the sheath. The above mentioned moisture absorbing and disabsorbing component is a modified polyalkylene oxides obtained as the reaction product of polyalkylene oxides, polyols and aliphatic diisocyanates, and the fiber-forming polymer in the sheath component is obtained from polyamide or polyester.

The modified polyalkylene oxide core component has a weight ratio of 5 to 30 weight % based on the weight of the total fiber. The nonwoven fabric has a designated structure of the bonded structure through the sheath components of the synthetic fiber or of three-dimensional entanglement of the synthetic fiber.

Consequently in the present invention there is provided that a synthetic fiber with a superior moisture absorbing and disabsorbing capability, which exhibits a moisture absorption or desorption function according to the condition of temperature and humidity of atmosphere and can exhibit the moisture absorbing and disabsorbing function repeatedly with changes in temperature and humidity, which has less tendency toward a change in color tone, especially yellowing, in storage over a long period of time, which has no problems in touch or dyeability when used as clothing materials; entangled and mixed yarn, knitted and woven fabrics, and nonwoven fabric using the above mentioned synthetic fiber.

Embodiments

The detailed description of the present invention will be given in the following paragraph.

The synthetic fiber capable of absorbing and disabsorbing moisture of the present invention comprises the moisture absorbing and the disabsorbing component and the fiber-forming polymer. It is necessary that the fiber has a moisture absorption of 1.5% or more when it is allowed to reach a moisture equilibrium under the circumstance of 25° C.×60%RH and then is allowed to stand for 30 min. under the circumstance of 34° C.×90%RH, and has a moisture disabsorption of 2% or more when it is allowed to reach a moisture equilibrium under the circumstance of 34° C.×90%RH and then is allowed to stand for 30 min. under the circumstance of 25° C.×60%RH.

Here the condition of temperature and humidity of 34° C.×90% RH approximately corresponds to the condition of temperature and humidity between human body and clothes when a human wears clothes over the midsummer from early summer. The condition of temperature and humidity of 25° C.×60%RH has been set on the assumption of temperature and humidity condition and indoor environment which is approximately average throughout the year.

Consequently if the fiber has a moisture absorption of 1.5% or more, preferably 2.5% or more, when it is allowed to reach a moisture equilibrium under the circumstance of 25° C.×60%RH and then is allowed to stand for 30 min. under the circumstance of 34° C.×90%RH, the synthetic fiber, when utilized to form clothes, is able to absorb moisture of the vapor perspiration from a human body quickly.

And also it has a moisture disabsorption of 2% or more, preferably 3% or more, when it is allowed to reach a moisture equilibrium under the circumstance of 34° C.×90%RH and then is allowed to stand for 30 min. under the circumstance of 25° C.×60%RH, the synthetic fiber, which once absorbed moisture, is able to desorb quickly the absorbed moisture from the inside space of clothes to the outside space usually having lower temperature and humidity than the ones inside the clothes.

It is difficult to measure actually moisture absorption and desorption separately because in the synthetic fiber the absorption of the vapor perspiration from the human body and the desorption of the same to the outside space of the clothes occur concurrently. Here, however, the moisture absorption and the moisture disabsorption is defined as the index.

It is necessary, as mentioned above, for the synthetic fiber of a the present invention to have moisture absorption of 1.5% or more and moisture disabsorption of 2% or more, and preferably it is desirable that the moisture disabsorption is equal to or more than the absorption. It is because that if the moisture disabsorption is lower than the moisture absorption, the vapor perspiration from the human body is accumulated by degrees with progress of time in the synthetic fiber, and may decrease the moisture absorption of the synthetic fiber. And if the moisture absorption is smaller than 1.5% or if the moisture disabsorption is smaller than 2%, the amount of moisture absorbed or desorbed themselves is small and as a result the inside of the clothes gets over humid.

The above described moisture absorption and desorption are provided by moisture absorbing and disabsorbing component used for synthetic fiber of the present invention. It is desirable for the moisture absorbing and disabsorbing component to have above described moisture absorption and desorption and a low degree of color tone change as described later. Preferably this moisture absorbing and disabsorbing component is a modified polyalkylene oxide obtained as the reaction product of polyalkylene oxides, polyols, and aliphatic diisocyanates. The modified polyalkylene oxide obtained as the reaction product of one or more compounds selected from the group below is the most preferable, because the modified polyalkylene oxide is fiber-forming polymer and, at the same time, can be melt spun. The examples of polyalkylene oxide are polyethylene oxide, polypropylene oxide, and copolymer of both. The examples of polyol are glycols such as ethylene glycol, diethylene glycol and propylene glycol. The examples of aliphatic isocyanate include cycloaliphatic diisocyanate and preferably include dicyclohexylmethane-4,4'-diisocyanate, 1,6-hexamethylene diisocyanate, etc.

Aromatic diisocyanates are not preferable for this usage because they give coloring or yellowing with progress of time.

A modified polyalkylene oxide used in the present invention is obtained as the reaction product of polyalkylene oxides, polyols, and symmetric aliphatic isocyanates. Especially the polyalkylene oxide with weight average molecular weight of 500 to 500,000 is preferably used. If the weight average molecular weight is less than 500, water absorption of a provided modified polyalkylene oxide extremely deteriorates, and at the same time the fiber-forming ability turns bad because of extremely high melt viscosity. On the other hand if the weight average molecular weight exceeds 500,000, obtained modified polyalkylene oxide, when it absorbs water, may be dissolved out from the nonwoven fabric in a form of gel. As the desired examples of the polyalkylene oxide with weight average molecular weight, polyethyleneoxide, polypropyleneoxide, ethyleneoxide/propyleneoxide copolymer and polybutyleneoxide or the mixture of above described polymers are suitable. And among these polyalkylene oxides with weight average molecular weight of 2,000 to 100,000, polyethyleneoxide, polypropyleneoxide and ethyleneoxide/propyleneoxide copolymer are preferably used.

Polyols are organic compounds which have two hydroxyl groups (—OH) in their molecular, and, for example, ethylene glycol, diethylene glycol, triethylene glycol, tetraethylene glycol, propylene glycol, dipropylene glycol, trimethylene glycol, 1,3-butanediol, 2,3-butanediol, 1,4-butanediol, 1,5-pentadiol, hexylene glycol, octylene glycol, glycerylmonoacetate, glycerylmonobutylate, 1,6-hexanediol, 1,9-nonanediol, bisphenol-A are suitable, and especially ethylene glycol, propylene glycol, 1,4-butanediol, 1,6-hexanediol and 1,9-nonanediol are preferably used.

As the symmetric aliphatic diisocyanate compounds reacted with the polyalkylene oxide and polyols are aliphatic isocyanate compounds which have two isocyanate groups in the symmetric position of the molecule, and, for example, dicyclohexylmethane-4,4'-diisocyanate or 1,6-hexamethylenediisocyanate are preferably used.

These modified polyalkylene oxides preferably have melt viscosity of 1,000 to 20,000 poise at 170° C. under weight loading of 50 kg/cm$^2$. If the melt viscosity is less than 1,000 poise, the polymer gel is dissolved out of the fiber surface when the fiber absorbs water. And on the other hand if the melt viscosity is more than 20,000, the fiber-forming ability turns poor because of insufficient dispersing ability in polyamide polymer or polyester polymer.

The synthetic fiber of the present invention is required to have a value of −1 to 5 in terms of b value in the CIE-LAB color system when it is allowed to stand for 30 days.

This b value is required to have almost no color tone change even in the finished fabric product and not to damage the commercial value, and preferably the b value is 0 to 3.

The b value of synthetic fiber varies according to the impurity of the materials used for fiber-forming polymer, polymeric condition and spinning condition. At present in many cases the main reason of coloring of the polymer results from the moisture absorbing and disabsorbing components used.

Accordingly it is necessary to improve the moisture absorbing and disabsorbing components in order to keep b value within the range mentioned above. In this point the above described modified polyalkylene oxides have exceedingly small coloring rate and is preferably used in the present invention.

The synthetic fiber of the present invention comprises the moisture absorbing and disabsorbing component and the fiber-forming polymer. As the form of the fiber examples as follows are proposed; fiber in which the moisture absorbing and disabsorbing component and the fiber-forming polymer are evenly or unevenly blended, sheath-core type, side-by-side type or island-sea structure type fiber in which the moisture absorbing and disabsorbing component and the fiber-forming polymer are independently located, various types of conjugate fiber such as multi-divided type fiber, in which one component is divided into several parts by the other component, conjugate fiber in which the blend mixture of a moisture absorbing and disabsorbing component and a fiber-forming polymer, as main component, is conjugated with other fiber-forming polymer.

The moisture absorbing and disabsorbing component may be arranged in both inner and/or outer part of the fiber. When the fibers are used in clothing materials, the moisture absorbing and disabsorbing component does not appear on the surface of the fiber and preferably located in the inner (core) part, not to have slippy touch when wet, uneven dyeing or poor color fastness.

The component ratio of the moisture absorbing and disabsorbing component and the fiber-forming polymer in the synthetic fiber may be set to fulfill the above mentioned moisture absorption and desorption simultaneously and, at the same time, it may be set according to the purpose or the end use of the fiber. For example when the above described modified polyalkylene oxide is used it is preferable that the component is within the weight ratio of 5 to 50 weight % on the weight of the fiber. If the content of the modified polyethylene oxide is less than 5 weight %, the desired moisture absorption and desorption may not be obtained, and on the other side if the content is more than 50 weight %, the fiber-forming ability may have some problems which is not preferable.

The examples of the fiber-forming polymer used in the present invention are polyamides such as nylon 6, nylon 66, polyester such as polyethylene terephthalate, polyolefin such as polyethylene and polypropylene and the copolymers of the above mentioned polymers but there is no limitation for the use of polymers. Any additives such as antioxidants, deglossing agents or ultraviolet absorbants may be used.

In addition, it is preferable that the single filament of a synthetic fiber capable of absorbing and disabsorbing moisture generally has fineness of 0.1 to 20 denier, but it is not particularly limited. A cross-section of fiber may have any kind of shape. It is preferable with a respect of cost that a synthetic fiber capable of absorbing and disabsorbing moisture of the present invention is used as continuous fiber of multi-filament, but it can be cut into staple fiber and used as spun yarn.

In the present invention, it is preferable that the synthetic fiber is a crimped textured yarn having crimp. Water absorption of knitted and woven fabrics highly improves by adopting this method when the synthetic fiber was processed into knitted and woven fabrics.

Water absorption of knitted and woven fabrics is classified roughly in two kinds. The first one is the water absorption which is used when water penetrates and spreads into void between knitted and woven fabrics or filaments. The second one is used when fiber itself absorbs water. When the synthetic fiber is given crimp, the void between filaments increases. If the knitted and woven fabrics using crimped yarn touches water, water can penetrate itself quickly into the voids between knitted and woven structure or filaments by capillary action, improving water absorption. This means that the first water absorption increases.

As for the synthetic fiber capable of absorbing and disabsorbing moisture of the present invention, fiber itself has water absorption. This means that the synthetic fiber capable of absorbing and disabsorbing moisture of the present invention has the second water absorption.

In the crimped textured yarn of the present invention, when knitted and woven, yarn or fiber itself has crimp. Therefore when the surface of the knitted and woven fabrics touches water, the water is spread into the voids between knitted and woven structure or filaments by water absorption effects due to crimp, and then the water is absorbed into the inside of the fiber according to the water absorption of the fiber itself. Therefore the crimped textured yarn of the present invention has superior water absorption by a synergistic effect of both water absorption mentioned above, and as a result has as high as or higher water absorption than natural fiber.

Any kind of crimping method can be used, for example false twist method, stuffing crimp method, and jet stuffing by hot jet of heated fluid.

In these methods, false twist method is preferable considering the stable quality and cost. General false twister with pin type or disk type twister can be used. General condition is adopted as false twisting condition. Usually the condition of false twist coefficient 15,000 to 33,000 is adopted. Here false twist coefficient is expressed in product of false twist number (T/m) and square root of fiber denier (d). However, the condition is not limited to these conditions mentioned above so long as effect of the present invention is provided. It is preferable to use two-step heater false twisting in which heat treating is performed in succession in order to control a torque after false twist.

Using this method, an entangled and mixed yarn can be obtained from the synthetic fiber capable of absorbing and disabsorbing moisture of the present invention. In detail in the entangled and mixed yarn of the present invention, the first fiber comprising the above described synthetic fiber capable of absorbing and disabsorbing moisture and the second fiber comprising polyester fiber are entangled. The above described fiber blend has a mixing weight ratio of (the first fiber)/(the second fiber)=20/80 to 80/20, and the first fiber has a higher boiling water shrinkage than the second fiber.

In the entangled and mixed yarn it is necessary that the first fiber is polyamide fiber having moisture absorption, in the condition 34° C.×90%RH, of 1.5 times or more of the one of nylon 6 in order to provide high water absorption and moisture absorption and desorption. If the moisture absorption is less than 1.5 times of nylon 6, desired antistatic property and moisture absorption and desorption are not obtained.

In the first fiber, as the polyamide which is used to include the modified polyethylene oxide, homopolymers of nylon 6, nylon 66, nylon 11, nylon 12, nylon MXD (polymethaxylylene adipoamide) and copolymers of these nylons mentioned above or the mixture are preferably used.

Compound fiber of sheath core type is preferably used as the first fiber. In particular it is desirable for the fiber to have core component of modified polyethylene oxide alone or mixture of modified polyethylene oxide and polyamide, and sheath component of polyamide. When the mixture of modified polyethylene oxide and polyamide is selected, it is possible that both polymers are melt and premixed to get master chip.

The first fiber formed by polyamide series may be manufactured according to conventional method. When the above described sheath core type compound fiber using the modified polyethylene oxide is used as polyamide series fiber, the composition ratio of the core and sheath varies according to the polymer used or to the property required. It is preferable, however, the composition ratio is in the range of 15/85 to 85/15 by weight. If the ratio of the core component is less than this range, entangled and mixed yarn obtained has poor antistatic property or moisture absorption and desorption. On the other hand if the ratio is more than this range, the fiber-forming ability may be damaged which is not preferable.

As polymer component of the second fiber comprising polyester fiber, homopolymers such as polyethylene terephthalate, polypropylene terephthalate, polybutylene terephthalate are used. Also copolymers obtained by copolymerizing the above described homopolymers, as a main part, with dicarboxylic acid such as isophthalic acid, 5-sodium sulfo isophthalic acid, naphthalene dicarboxylic acid, and adipic acid or with other glycol component are used. In addition, the mixture of the polyesters is preferably used.

Single filament fineness of polyester fiber constituting the second fiber is not particularly limited. If multifilament yarn with single filament fineness of less than 1.5 d is used, the knitted or woven fabric can obtain peach touch and moreover the water absorption of the fabric is improved.

When the first fiber formed of polyamide fiber and the second fiber formed of polyester fiber are entangled and blended, conventional airjet-texturing technique using airjet nozzle, interlacer and others may be adopted. The number of intermingle which means the degree of entangle or intermingle may have the value within the range of 20 to 120 times/m.

It is necessary for the entangled and mixed yarn to have a mixing weight ratio of (the first fiber)/(the second fiber)=20/80 to 80/20, and preferably within the ratio of 30/70 to 70/30. If the mixing weight ratio is less than 20% of the first fiber, required antistatic property, water absorption, moisture absorption and desorption are not provided. If the mixing weight ratio of the first fiber exceeds 80% of the first fiber, the touch of polyester constituting the second fiber is not provided. And it is difficult to use a high-degree caustic reduction process in caustic treatment which is used in finishing the fabric woven using the yarn blend to manufacture fabrics for blouses and shirts. As a result it is difficult to obtain soft touch. Furthermore, sometimes the pollution to the polyamide series fiber by the disperse dye used for dyeing polyester fiber increases, and as a result color fastness may get poor.

It is necessary for the boiling water shrinkage of polyamide series fiber as the first fiber of an entangled and mixed yarn to be higher than that of polyester fiber as the second fiber.

Boiling water shrinkage here is measured and calculated by the method as follows.

Yarn is wound to make a certain length of hank by hank machine, and then the length of the hank (a) is measured under initial load of 0.1 g/d. After the hank under no load is boiled for 30 min. in boiling water, it is dried. The length (b) of the hank is measured under initial load of 0.1 g/d. Boiling water shrinkage is obtained in the equation as follows.

$$\text{Boiling water shrinkage}(\%)=[(a-b)/a]\times 100$$

If the boiling water shrinkage of the first fiber of polyamide series fiber is equal to or less than the one of the second fiber of polyester fiber, it is difficult for loops formed by mainly monofilaments of the polyester fiber to appear over the surface of the polyamide series fiber, and consequently, in some case, the touch of the polyester fiber cannot be obtained or the color fastness to light is damaged.

The boiling water shrinkage differential between the polyamide series fiber and the polyester fiber is not particularly limited, but it is preferable that the polyamide series fiber has 3%, preferably 5% higher shrinkage than polyester fiber.

The dry shrinkage of the polyester fiber has a value smaller than polyamide series fiber and has preferably a value of equal to or less than 2%.

The dry shrinkage here is measured and calculated by the method as follows.

The length ($I_0$) of a yarn sample of about 30 cm is measured under load of 0.05 g/d. The yarn is then allowed to stand without any load at 160° C. for 30 min. The length ($I_1$) of the yarn is measured under load of 0.05 g/d. The dry shrinkage is obtained in the equation as follows.

$$\text{Dry shrinkage}(\%)=[(I_0-I_1)/I_0]\times 100$$

If the dry shrinkage of the polyester fiber has a value of less than the one of the polyamide fiber and less than 2%, especially less than 3%, the bulkiness and peach touch of the knitted and woven fabrics is highly increased.

It is preferable for an entangled and mixed yarn of the present invention that an antistatic property is equal to or less than 1,000V. An antistatic property here is the value that is measured according to following JIS (Japanese Industrial Standards) for the sample which is dyed by conventional method after tube knitted using entangled and mixed yarn of the present invention.

Friction-charged electrostatic potential: JIS L-1094B method.

If the antistatic property of sample is equal to or less than 1,000V, excellent antistatic effect is obtained, and as a result in the dry circumstance as in winter there does not occur hang about or clinging of clothes to body or adhesion of dust caused by static electricity.

It is preferable for an entangled and mixed yarn of the present invention that water absorption is equal to or more than 150%. The water absorption defined here is calculated in the following manner that after the sample, which is allowed to stand in the condition of 25° C.×60%RH for 2 hours, is weighed to get weight of W, and then the weight one minute after absorbing water $W_{60}$ is obtained according to the method defined by JIS L-1907 5.3. The water absorption R (%) is calculated by the equation as follows.

$$R(\%)=[(W_{60}-W)/W]\times 100$$

If the water absorption is equal to or more than 150%, the perspiration during wearing is preferably absorbed into the clothes quickly.

It is preferable for the entangled and mixed yarn of the present invention to have moisture absorption equal to or more than 1.5%. Moisture absorption here is defined as the differential of the moisture content after standing in the condition of 25° C.×65%RH for 2 hours and the moisture content after standing in the condition of 34° C.×90%RH for 24 hours. If the moisture absorption is equal to or more than 1.5%, the perspiration in vapor during wearing is quickly absorbed into the fiber and over humidity is preferably not recognized.

Knitted and woven fabrics of the present invention are woven or knitted fabric constituted mainly by the entangled and mixed yarn mentioned above. This knitted and woven fabrics may be obtained by using 100% of the entangled and mixed yarn mentioned above, and may be obtained by mixing the entangled and mixed yarn with other yarns by the method of weaving or knitting as long as the property of the present invention is not diminished.

In brief in the entangled and mixed yarn of the present invention, the polyamide series fiber as the first fiber, constituting the entangled and mixed yarn together with the polyester series fiber as the second fiber, contains nylon 4 having high moisture absorption and desorption, or high moisture absorbing and disabsorbing and water absorbing polymer such as polyvinyl pyrrolidone, polyetherester amide and modified polyethyleneoxide. Therefore superior moisture absorption and desorption and a certain degree of water absorption are obtained.

In addition, because an entangled and mixed yarn of the present invention is constituted by the polyester fiber and the polyamide series fiber with higher boiling water shrinkage than the one of polyester fiber, loops and void formed by mainly monofilaments of polyester fiber are forced to appear on the surface of polyamide series fiber by the heat treatment popular in dyeing process. Therefore the entangled and mixed yarn of the present invention can provide high water absorption.

Furthermore, the knitted and woven fabrics containing mainly the entangled and mixed yarn mentioned above can provide the touch of polyester and at the same time can keep the clothes comfortable without any slippy or tacky wet touch, because in wearing the swelled polyamide series fiber absorbing perspiration and moisture does not have contact to the skin.

In addition if the polyester fiber with single filament fineness of equal to or less than 1.5 d and with dry shrinkage value smaller than the one of the polyamide series fiber and of equal to or less than 2% is used as polyester fiber, the knitted and woven fabrics can obtain superior bulkiness and peach touch.

The antistatic property of polyamide series fiber constituting the entangled and mixed yarn of the present invention has friction-charged electrostatic potential of around 2,000V. As compared to general synthetic fiber, it is in the level in which clothes do not cling to skin even if static electricity occurs, but adhesion of dust by static electricity is not prevented. Adhesion of dust does not disappear unless friction-charged electrostatic potential is equal to or less than 1,000V. It is, however, possible to obtain a high grade antistatic property to use polyamide series fiber together with polyester fiber as the entangled and mixed yarn of the present invention. The reason is not clear, but the present inventors understand as follows.

Considering triboelectric series of polyamide and polyester, when polyamide is given static electricity, it has positive charge. On the other hand when polyester is given static electricity it has negative charge. Cotton, silk, rayon, acetate and acrylic fibers are located between the triboelectric series of polyamide and polyester. By the contact with these fibers, polyamide once has positive charge and polyester once has negative charge but next these charges deny each other and as a result total quantity of charging becomes low. In this case a quantity of denied charge varies depending on the mixing ratio of polyamide series fiber and polyester fiber, but excellent antistatic property is provided if the mixing ratio is between the above described range.

Nonwoven fabric of the present invention will be explained in detail next.

As the polyamide adopted as sheath component or a part of the sheath component of the staple fiber constituting the nonwoven fabric, amide polymers such as nylon 4, nylon 6, nylon 46, nylon 66, nylon 11, nylon 12, nylon MXD6 (polymethaxylene adipoamide), polybiscyclohexylmethane decanamide, or the copolymer containing these polymers mentioned above or the mixture of the same are adopted. In addition, as acid component of polyester, aromatic dicarboxylic acid such as terephthalic acid, isophthalic acid, naphthalene-2,6-dicarboxylic acid and aliphatic dicarboxylic acid such as adipic acid and sebacic acid or esters from these acids mentioned above are proposed. As glycol component, diols such as ethylene glycol, dietylene glycol, 1,4-butanediol, neopentyl glycol, cyclohexane-1,4-dimethanol are proposed. Ester polymers or copolymers obtained from these components are also used. And paraoxybenzoic acid, 5-sodiumsulfoisophthalic acid, polyalkylene glycol, pentaerythritol and bisphenol A may be added or coplymerized to the ester series polymers mentioned above.

Above described modified polyalkylene oxides are adopted in the present invention.

In nonwoven fabric of the present invention, it is preferable for the staple fiber constituting the nonwoven fabric to have weight ratio of modified polyalkylene oxide of core component of 5 to 30% of fiber weight. If this weight ratio is less than 5%, moisture absorption and desorption of staple fiber, namely of nonwoven fabric, deteriorates. On the other hand, if this ratio exceeds 30%, the moisture absorption and desorption is excellent, but the tendency of decreasing of tensile strength of staple fiber, namely of nonwoven fabric, is observed.

In the nonwoven fabric of the present invention the composition ratio of the sheath and core (sheath/core composition ratio) has the value of sheath/core(by weight)=95/5 to 70/30 when the core component is composed of only modified polyalkylene oxide. And when sheath component is composed of the mixture of modified polyalkylene oxide and polyamide or polyester, the composition ratio does not have limitation especially. It is, however, preferable that the composition ratio has the value of sheath/core(by weight)= 60/40 to 40/60 considering fiber-forming ability and the moisture absorption and desorption of the staple fiber, namely nonwoven fabric. If the value of the composition ratio is more than the above described range, the moisture absorption and desorption of the staple fiber turns good but the fiber-forming ability turns poor, moreover tensile strength of staple fiber, namely of the nonwoven fabric deteriorates, and as a result even cross-section of the single filament cannot be obtained. On the other hand if compound ratio of core component is smaller than above range, the fiber has excessive thickness of the sheath component and the moisture absorption and desorption of staple fiber deteriorates with excessive polyamide or polyester dispersing in the modified polyalkylene oxides of core component.

It is necessary in the nonwoven fabric of the present invention that the above described staple fiber substantially has core sheath type composition. Core component gives moisture absorption and desorption to staple fiber, and therefore nonwoven fabric has moisture absorption and desorption. In addition, sheath component gives a fiber-forming ability and tensile strength to staple fiber, and therefore strength of nonwoven fabric is improved.

This staple fiber may have a multicore type sheath core structure as well as conventional sheath core structure. In addition, the form of the cross-section of the staple fiber is not particularly limited if the staple fiber has sheath core type section substantially. A cross-section may be selected from the section adopted in general fiber such as multi-leaves, oval or others as well as usual circular section. These polymers may be melted and premixed to get master chip or dry blended.

In the nonwoven fabric of the present invention, it is possible, if necessary, to mix the core component of the sheath core type staple fiber with water absorbing polymers such as sodium polyacrylate, poly-N-vinylpyrrolidone, poly (metha)acrylic acid or the copolymer of the above described polymers and polyvinylalcohol within the range of providing the effect of the present invention.

In addition, it is also possible to use mix the core component and/or sheath component of the sheath core type staple fiber, if necessary, with several additives such as deglossing agents, colorants, flame retardants, deodorants, Light proof agents, heat resistant reagents and anti oxidants within the range of providing the effect of the present invention.

In particular, it is preferable to use benzotriazole type Light proof agents in the sheath component and to use phenol type antioxidants in the core component in order to improve heat resistance and light fastness. As benzotriazole type Light proof agent 2-(2-hydroxy-3,5-di-t-amylphenyl) benzotriazole ("Seesorb704" Shipuro Kasei Kaisha LTD.), as phenol type antioxidant 2-t-pentyl-6-(3,5-di-t-pentyl-2-hydroxybenzyl)-4-t-petylphenylacrylate ("Sumilizer GS" Sumitomo Chemical Co., LTD.) are preferably used.

In the nonwoven fabric of the present invention the nonwoven structure is maintained, for example, by the heated and pressed adhesion between each component fiber in the partially heated and pressed adhesion area, and by the point welding based on thermal adhesion treatment between each of the component fiber by heat treatment in the oven or in other devices. That is, the structure is maintained by the adhesion via the sheath component of the sheath core type fiber.

The partially heated and pressed adhesion is obtained, for example, by pressing the material between heated embossing roll and smooth faced metal roll. The fiber contacted to the embossing pattern on the embossing roll is melted and adhered together and dotted melted area is formed. Mechanical characteristic such as form retention and dimensional stability and tensile strength is given to the nonwoven fabric by this partially heated and pressed adhesion.

In addition, a conventionally known method is adopted as a method to have point welding of component fiber together by thermal adhesion treatment. Hot air circulating type dryer, hot air flow through dryer, suction drum dryer and yankee drum dryer are used as heat treating device. The heat treating temperature and period is selected properly according to the melting point of the sheath component of the fiber. In addition, kneedling processing may be adopted before heat treatment.

When this kind of thermal adhesion treatment is used to get nonwoven fabric, it is acceptable to add binder fiber with low melting point to the component fiber. In this case the material of binder fiber is not particularly limited. As for the polymer constituting binder fiber, however, the polymer with good solubility with sheath component of compound fiber and with melting point lower more than 5 degrees than sheath component polymer is preferable.

In addition, nonwoven fabric of the present invention maintains shape as nonwoven fabric by three-dimensional entanglement between component fibers. For example, this three-dimensional entanglement between component fibers is formed by giving jet of high pressure liquid to the web. This three-dimensional entanglement provides the nonwoven fabric with form retention property, practically enough tensile strength and flexibility.

The nonwoven fabric of the present invention can be manufactured efficiently according to the method mentioned below.

After polyamide or polyester constituting sheath component of staple fiber, and above described polymer constituting core component, namely a modified polyalkylene oxide or mixture of this modified polyalkylene oxide and polyamide or polyester are separately melted, the melted polymers are spun out using a known combined type nozzle. After the melt spun filaments are cooled by the known cooling device and oiled, the filaments are taken up, by roll to obtain undrawn yarn. Once the yarn is taken up, it is drawn without being wound up. And a drawn yarn thus obtained is given mechanical crimp using crimping device as stuffing box, and then cut into predetermined length to give staple fiber.

As drawing process one-step or multi-step drawing machine in the non-heated or heated condition is used. The drawing ratio or drawing temperature in the step of drawing the undrawn yarn may be selected appropriately according to the adopted polymer type or the amount of modified polyalkylene oxide used as the core component.

The number of crimps of the mechanical crimp is 8 to 35/25 mm, preferably 10 to 30 times/25 mm. If the number of crimp is less than 8/25 mm, un-opened parts are easily obtained in the next carding process. On the other hand if the number of crimps is more than 35/25 mm neps are easily obtained.

It is preferable that a percentage of crimp is equal to or more than 5.0%. A cohesiveness of fiber turns bad in the next carding process if a percentage of crimp is less than 5.0%, and as a result uneven density is easily obtained in the web.

Subsequently this staple fiber is carded using carding machines, and carded web is obtained. The staple fiber nonwoven fabric of the present invention is obtained by giving partially heated and pressed adhesion to the provided carded web to have heated and pressed adhesion of component fiber, by giving heat treatment in an oven or by giving high pressure liquid treatment to have three-dimensionally entangled component fibers.

The fiber in the carded web may be arranged according to any method selected from the method as the parallel fiber web with component fiber arranged in a machine direction of the carding machine, the random fiber web with component fiber arranged at random or the semi random fiber web in which component fiber is arranged in the intermediate of both.

Raw fiber, in other words, the component fiber of nonwoven fabric of the present invention, used in manufacturing of the web may contain at least a certain predetermined amount of the staple fiber mentioned above. Accordingly the staple fiber may be used alone or mixed with other staple fibers.

When the web is treated in the process giving partially heated and pressed adhesion, heated embossing roll and smooth faced metal roll are used and the fiber contacted with the embossing pattern on the embossing roll is melted and adhered to form dotted melted area.

This partially heated and pressed adhesion spot has specified area in the surface of the web, and it is not necessary for individual pressed adhered spot to be always circular. The spot preferably has area of 0.1 to 1.0 $mm^2$, and location density, in other words, the pressed adhered spot density has a value of 2 to 80 spots/$cm^2$, more preferably 4 to 60 spots/$cm^2$. If the pressed adhered spot density is less than 2 spots/$cm^2$, the mechanical properties of the nonwoven fabric obtained by heated and pressed adhesion treatment such as form retention property, tensile strength or dimensional stability are not increased. On the other hand if the density exceeds 80 points/$cm^2$, the flexibility and bulkiness of the nonwoven fabric is decreased. The heated and pressed adhesion area ratio defined as the ratio of all the heated and pressed area for all surface area of a web has a value of 2 to 30%, preferably 4 to 20%. If the above described ratio is less than 2%, the mechanical properties of the nonwoven fabric obtained by heated and pressed adhesion treatment such as form retention property, tensile strength or dimensional stability are not increased. On the other hand if the above described ratio exceeds 30%, the flexibility and bulkiness of the nonwoven fabric is decreased.

When the component fibers are three-dimensionally entangled by high pressure liquid treatment, a known method can be used.

For example, there is a method in which the apparatus with array of plurality of jet nozzles having diameter of 0.05 to 1.0 mm, especially of 0.1–0.4 mm, is used. The method gives jet of high pressure liquid of injection pressure 40–100 kg /$m^2$G from the nozzle mentioned above. Nozzles are arranged in rows in an orthogonal direction of progress direction of a web. This treatment by jet may be given to one side or both sides of the web. In the one side treatment if the jet nozzles are arrayed in plurality of lines and the jet pressure is set low at the first step and high at the following step, nonwoven fabric with even and dense entanglement and even formation are obtained.

It is general to use water in normal or raised temperature as high pressure liquid. The distance between nozzle and web is preferably 1 to 15 cm. If this distance is less than 1 cm, the disordered formation of a web is undesirably obtained, and on the other hand when this distance considerably exceeds 15 cm, impact strength of liquid stream colliding with a web is decreased, resulting in poor three-dimensional entanglement of fibers. This high pressure liquid treatment may be adopted in continuous method or in separated method.

When excessive amount of water is removed from the web after the high pressure liquid treatment, any known method may be used. For example, the residual water is removed using squeezer such as mangle roll, and then the web is dried by drying means such as hot air dryer.

EXAMPLES

The present invention is specifically illustrated by examples below. However, the present invention is not limited by these examples.

In examples and comparative examples explained as follows, the measurement of various physical property value was performed by the following methods.

(1) Melt viscosity of a modified polyalkylene oxide

Modified polyalkylene oxide 1.5 g were used as measuring sample, and, using flow tester (CFT-500D made by Shimadzu Corporation), it was measured under the condition of load 50 kg/$cm^2$, temperature 170° C., with die diameter of 1 mm, die length of 1 mm.

(2) Water absorption ability of a modified polyalkylene oxide

Weighed 1 g of modified polyalkylene oxide was added to 200 ml of pure water. After stirred for 24 hours, the sample was filtered with 200 mesh metal gauze. The weight of the filtered gel was defined as water absorption ability [g(pure water)/g(resin)].

(3) A moisture absorption and a moisture disabsorption (a) After sample of knitted tube fabric or nonwoven fabric was dried for 2 hours at 105° C. it is weighed to obtain weight $W_0$.

(b) Then the weight $W_1$ of the sample which was allowed to stand under the condition of 25° C.×60%RH for 24 hours was measured.

(c) This sample was next moved to the atmosphere of temperature 34° C.×90%RH, and sample weight $W_2$ after 30 min. was measured.

(d) After measuring of $W_2$, the sample was allowed to stand under the same condition for 24 hours. The sample weight $W_3$ was then measured. In the next step the sample was moved to the condition of 25° C.×60%RH. After the sample was allowed to stand for 30 min. sample weight $W_4$ was measured.

(e) After measuring of $W_4$, conventional wash was done using detergent available in market and washing machine for home use, and the sample then was dried in the sun outdoors.

The operation of above (b) to (e), as one cycle, was repeated for 5 times, and a moisture absorbing and disabsorbing capability after n times of repeat was determined by following equation.

$$\text{moisture absorption}(\%)=[(W_2-W_1)/W_0]\times 100$$

$$\text{moisture disabsorption}(\%)=[(W_3-W_4)/W_0]\times 100$$

(4) b value

Using MS-2020 type spectrophotometer made by Macbeth company the light reflectance of sample of knitted tube fabric or nonwoven fabric was measured. B value was demanded by color difference equation CIEL-AB defined by International Commission on Illumination. (Actually output automatically by spectrophotometer). In measuring to make influence by reflected light from other than knitted tube fabric as small as possible, knitted tube fabric or nonwoven fabric was folded, and after it was checked that light did not pass through clearance of formation by visual observation, measuring was performed.

After the fiber was produced, the fiber was allowed to stand in a place where sunlight is incident but direct sunlight is not irradiated in a room without temperature/humidity control for 30 days. The knitted tube fabric was then manufactured using this fiber.

(5) Color fastness −1

Measuring was carried out based on JIS L 0844 (color fading was shown).

(6) Touch when moisture absorbed sensory test was carried out by hand. For no slippy touch: ○, a little slippy touch: Δ, slippy and not suitable for clothing x.

(7) Water absorption −1

Measuring was carried out based on JIS L 1018 (water drop method and Byreck method). In Byreck method was measured after 3 min.

(8) Water absorption −2

After sample was allowed to stand under the condition of 25° C.×60%RH for 2 hours, weight W of a sample before water absorption is measured. Weight $W_{60}$ after absorption of water for 1 minute was measured by water absorption measurement prescribed with JIS L-1907 5.3. Water absorption ratio R was determined by following equation.

$$R(\%)=[(W_{60}-W)/W]\times 100$$

(9) Antistatic property

Antistatic property was measured based on the following JIS.

Half period: JIS L-1094A method

Friction-charged electrostatic potential: JIS L-1094B method

(10) Color fastness −2

Discoloration and staining in color fastness was determined based on the following JIS for the dyed sample.

Color fastness to light: JIS L-0842

Color fastness to washing: JIS L-0844

Color fastness to perspiration: JIS L-0848

Color fastness to rubbing: JIS L-0849

(11) Slippy touch

After the sample was exposed to water for 1 minute using the above described method of Water absorption−2, touch of the sample was determined by sensory test and classified to two grade "with" and "without".

(12) Polyester touch

Polyester touch "with" or "without" was determined by sensory test.

(13) Bulkiness

Bulkiness "with" or "without" was determined by sensory and visual test.

(14) Relative viscosity of polyamide

Measured by conventional method using sulfuric acid with a concentration of 96% by weight as solvent and under the condition of sample concentration of 1 g/100 cc and 25° C.

(15) Relative viscosity of polyester

Measured by conventional method using the mixture of even amount of phenol and tetrachloroethane, under the condition of sample concentration of 0.5 g/100 cc and 20° C.

(16) Weight of nonwoven fabric 10 sheets of nonwoven fabric sample in normal condition of 10 cm×10 cm were prepared, and after being allowed to reach moisture equilibrium they were weighed in grain. The weight obtained was calculated to give even weight per unit of area ($g/m^2$)

(17) Tensile strength of nonwoven fabric

Measured based on JIS L-1096A method. In detail, for both direction of course and wale, 10 samples of 2.5 cm width and 20 cm length were prepared. The sample was measured using constant rate of extension testing machine (Tensilon UTM-4-1-100, Toyo Baldwin Co.), and under the conditions of sample grip interval of 10 cm and tensile rate of 10 cm/minute. Average of load value (g/2.5 cm width) obtained as load at breakage was defined as tensile strength (g/2.5 cm width).

(18) Bending resistance of nonwoven fabric

Five pieces of sample (10 cm length, 5 cm width) was prepared. Each sample piece was turned into form of tube in cross direction. The sample tube was compressed in the axes direction using constant rate of extension testing machine (Tensilon UTM-4-1-100, Toyo Baldwin Co.,) under the condition of compression speed of 5 cm/minute. The average load of maximum load (g) of 5 samples was defined as bending resistance (g) of nonwoven fabric.

Examples 1 to 4

Nylon 6 or polyethylene terephthalate was used as fiber-forming polymer. As moisture absorbing and disabsorbing component, modified polyethyleneoxide which was obtained as reaction product of polyethyleneoxide, 1,4-butanediol and dicyclohexylmetane-4,4-diisocyanate (water absorption 35 g/g, melt viscosity 4000 poise) or the mixture of this modified polyethyleneoxide and fiber-forming polymer was used. The polymer was melt spun using sheath core type of nozzle and then is drawn. Drawn yarn of 50 d/24 f was obtained. The above described modified polyethyleneoxide was obtained according to the known manufacturing method of water absorption resin described in JP-A-6-316623.

Spinning conditions and evaluation results are shown in table 1. In table 1, ratio represents weight ratio so long as not particularly explained.

TABLE 1

| | | | Example 1 | Example 2 | Example 3 | Example 4 | Example 5 |
|---|---|---|---|---|---|---|---|
| Spinning condition | Core component | Polymer | N6 + PEO | N6 + PEO | PEO | PET + PEO | N6 + PEO |
| | | Blend ratio | 70/30 | 80/20 | 100 | 70/30 | 80/20 |
| | Sheath component | Polymer | N6 | N6 | N6 | PET | N6 |
| | | Blend ratio | 100 | 100 | 100 | 100 | 100 |
| | Core/sheath ratio | | 40/60 | 50/50 | 20/80 | 20/80 | 50/50 |
| Evaluation | Moisture absorption 1 (%) | | 9.5 | 7.9 | 12.2 | 2.2 | 4.4 |
| | Moisture disabsorption 1 (%) | | 10.7 | 9.2 | 14.4 | 2.6 | 4.8 |

TABLE 1-continued

| | Example 1 | Example 2 | Example 3 | Example 4 | Example 5 |
|---|---|---|---|---|---|
| Moisture absorption 5 (%) | 9.8 | 8.0 | 12.0 | 2.4 | 4.5 |
| Moisture disabsorption 5 (%) | 10.7 | 9.4 | 14.3 | 2.6 | 4.8 |
| b value | 2.5 | 1.6 | 2.1 | 3.0 | 1.4 |
| Color fastness (grade) | 4–5 | 5 | 3–4 | 4 | 5 |
| Touch when moisture absorbed | ○ | ○ | ○ | ○ | ○ |

Note:
N6: Nylon 6
PET: Polyethylene terephthalate
PEO: Modified polyethylene oxide

Example 5

The synthetic fiber capable of absorbing and disabsorbing moisture obtained in example 2 was crimped in stuffing using a stuffing box. Then this fiber was cut into 51 mm length, and staple fiber of single filament fineness 2.2 denier was obtained.

The staple fiber obtained and conventional nylon 6 staple fiber (length of fiber 51 mm, single filament fineness 2.5 denier) were mixed in weight ratio of 50/50, and were spun giving 40 count of spun yarn.

The spinning conditions used and evaluation results are shown in table 1.

As shown in table 1, it is apparent that all of synthetic fibers obtained with examples 1 to 5 have superior moisture absorption and desorption and little color tone change by long term storing. These synthetic fibers can be of practical use as dress material and lining of clothes.

Comparative Example 1

In example 2, 4,4'-diphenylmethane diisocyanate with aromatic ring was used as raw material of modified polyethyleneoxide instead of dicyclohexylmethane-4,4'-diisocyanate. Besides this change the same method is carried out as in example 2, and drawn yarn of 50 d/24 f was obtained.

The moisture absorption and desorption of obtained fiber was in almost the same range as in example 2, but b value of 30 days after manufacturing was 13.7 and the fiber has significant yellowing.

Comparative Examples 2 and 3

Moisture absorption of the conventional nylon 6 fiber and polyethylene terephthalate fiber which do not include moisture absorbing and disabsorbing component was measured. The moisture absorption was only 0.9% and 0.3%, respectively, the moisture disabsorption was only 0.7% and 0.2%, respectively.

Examples 6 to 8

Nylon 6 or polyethylene terephthalate was used as fiber forming polymer as in examples 1 to 5. As moisture absorbing and disabsorbing component, modified polyethyleneoxide which was obtained as reaction product of polyethyleneoxide, 1,4-butanediol and dicyclohexylmetane-4,4'-diisocyanate (water absorption 35 g/g, melt viscosity 4000 poise) was used. And a blended mixture of fiber-forming polymer and moisture absorbing and disabsorbing component was used. Highly oriented undrawn fiber of 50 d/24 f was spun using sheath core type nozzle in which the mixture was located in the core position at spinning speed of 3600 m/minute. The above described modified polyethyleneoxide was obtained according to the known manufacturing method of water absorption resin described in JP-A-6-316623.

Highly oriented undrawn fiber obtained was textured using false twister equipped with feed roller, false twisting heater, pin type twisting device, delivery roller and winder in this order.

The spinning and twisting conditions and evaluation results of false twisted and crimped textured yarn are shown in table 2. In table 2, ratio represents weight ratio so long as not particularly explained.

TABLE 2

| | | | Example 6 | Example 7 | Example 8 | Example 9 | Comparative Example 4 | Comparative Example 5 |
|---|---|---|---|---|---|---|---|---|
| Spinning condition | Core component | Polymer | N6 + PEO | N6 + PEO | PET + PEO | PEO | N6 + PEO | N6 |
| | | Blend ratio | 70/30 | 85/15 | 70/30 | 100 | 85/15 | 100 |
| | Sheath component | Polymer | N6 | N6 | PET | N6 | N6 | N6 |
| | | Blend ratio | 100 | 100 | 100 | 100 | 100 | 100 |
| | Core/sheath ratio | | 40/60 | 50/50 | 20/80 | 20/80 | 50/50 | 50/50 |
| False twisting condition | Drawing ratio | | 1.15 | 1.25 | 1.38 | 1.20 | 1.25 | 1.25 |
| | Temperature (° C.) | | 170 | 180 | 190 | 175 | — | 180 |
| | Number of false twist (T/m) | | 3100 | 4200 | 4600 | 3600 | — | 4200 |
| | False twist coefficient | | 21000 | 27000 | 28000 | 24000 | — | 27000 |
| | Fineness after false twist (d) | | 44 | 41 | 37 | 43 | 42 | 41 |

TABLE 2-continued

| | | | Example 6 | Example 7 | Example 8 | Example 9 | Comparative Example 4 | Comparative Example 5 |
|---|---|---|---|---|---|---|---|---|
| Evaluation | Moisture absorption 1 (%) | | 9.5 | 6.8 | 2.3 | 12.3 | 6.8 | 1.0 |
| | Moisture disabsorption 1 (%) | | 10.7 | 7.8 | 2.7 | 14.6 | 7.8 | 0.8 |
| | Moisture absorption 5 (%) | | 9.7 | 7.0 | 2.2 | 12.4 | 6.8 | 0.9 |
| | Moisture disabsorption 5 (%) | | 10.8 | 8.0 | 2.6 | 14.7 | 7.9 | 0.8 |
| | Water absorption | Water drop | Less than 1 second | Less than 1 second | Less than 1 second | Less than 1 second | 50.6 seconds | Less than 1 second |
| | | Byreck | 11.5 cm | 10.4 cm | 7.4 cm | 13.9 cm | 3.6 cm | 6.6 cm |
| | b value | | 2.7 | 1.9 | 4.0 | 3.6 | 1.5 | 1.9 |
| | Color fastness (grade) | | 4–5 | 5 | 4 | 4 | 5 | 5 |
| | Touch when moisture absorbed | | ○ | ○ | ○ | ○ | ○ | ○ |

Note:
N6: Nylon 6
PET: Polyethylene terephthalate
PEO: Modified polyethyleneoxide

Example 9

The core component of sheath core compound fiber was formed only with modified polyethyleneoxide, and the sheath component was formed with polyethylene terephthalate. The ratio of core/sheath was 20/80 by weight. Besides of these change the same method as in examples 6 to 8 was carried out, and a false twisted and crimped textured yarn was obtained.

The spinning and twisting condition used and evaluation results of false twisted yarn are shown in table 2.

Comparative Example 4

Highly oriented undrawn fiber in example 6 was used. The yarn was drawn without false twisting at drawing ratio as in example 6 and drawn yarn was obtained.

Comparative Example 5

Modified polyethyleneoxide was not used. Besides of this change the same method as in examples 6 was carried out to obtain false twisted yarn of only nylon 6.

The spinning and twisting condition and evaluation results of false twisted and crimped textured yarn in the comparative examples 4 and 5 are shown in table 2.

As is apparent from Table 2, the twisted yarns obtained in examples 6 to 9 have superior moisture absorption and desorption, water absorption, and little color tone change by long term storing. When they are processed to provide knitted and woven fabrics, they have excellent color fastness, no slippy touch when moisture absorbed, and they can provide the most suitable textured yarn in the clothing usage.

On the other hand the yarn without crimp obtained in comparative example 4 has inferior water absorption. In addition, the crimped textured yarn without modified polyethyleneoxide in comparative example 5 had inferior moisture absorption and desorption.

Example 10

Eighty five parts of nylon 6 with relative viscosity of 2.6 measured under the condition of concentration 0.5 g/dl in m-cresol solvent and temperature of 20° C., and 15 parts of modified polyethyleneoxide obtained as the reaction product of polyethyleneoxide, 1,4-butanediol and dicyclohexylmethane-4,4'-diisocyanate (water absorption 35 g/g, melt viscosity 4000 poise) were dry blended. The dry blended mixture was used as core component and the nylon 6 mentioned above was used as sheath component to be melt spun. And sheath core type compound fiber having weight ratio of core/sheath=50/50 was obtained. In the spinning process using 12 holes of nozzle, the polymer was melt spun at 255° C. The yarn was then cooled by air stream of 18° C., oiled, and wound at 1300 m/minute. The yarn then was drawn at drawing ratio of 3.0 to obtain sheath core type compound fiber of 50 d/12 f. The above described modified polyethyleneoxide was obtained according to the known manufacturing method of water absorption resin described in JP-A-6-316623.

The polyamide series fiber obtained had boiling water shrinkage of 12.8% and dry shrinkage of 6.5%.

Then the melt spinning was carried out using polyethylene terephthalate of relative viscosity 1.38 measured under the condition of concentration of 0.5 g/dl and temperature of 25° C. in the mixture solvent of phenol and tetrachloroethane in the same weight. In the spinning process using nozzle with 36 round hole the polymer was melt spun at 285° C. The yarn was then cooled by air stream of 18° C. The yarn was then oiled, wound at 3600 m/min, and drawn at drawing ratio of 1.5 to obtain polyester fiber of 50 d/36 f.

The polyester fiber obtained had boiling water shrinkage of 5.1% and dry shrinkage of 4.6%.

The polyamide series fiber and polyester fiber obtained by above described method was air interlaced using Interlacer JD-1 manufactured by Dupont Chemical Co., under the condition of yarn speed of 600 m/minute, air pressure of 1 $Kg/cm^2$ and over feed ratio of 2.0%, and the entangled and mixed yarn of the present invention is obtained.

The number of intermingle of the entangled and mixed yarn obtained was 58/m.

Plane woven fabric with warp yarn density of 120/2.54 cm and weft yarn density of 87/2.54 cm was then obtained using the above described yarn blend as warp and weft yarn. The gray fabric was scoured, pre-set, causticized (causticized reducing weight ratio 18.2%) and dyed using 1% owf Sumikaron Yellow ERPD (disperse dye of Sumitomo Chemical Co., LTD.) and 1% owf of Lanaset Yellow 2R (acid dye of Japan Ciba-Geygy Co., LTD.) at 120° C. for 30 min. The fabric was then treated in the process of reduction cleaning, dried at 110° C. for 60 minutes, heat set at 170 degree for 30 seconds. And the fabric of the present invention was obtained.

The evaluation results of the entangled and mixed yarn and the fabric are shown in table 3.

As is shown in table 3 it is apparent that the entangled and mixed yarn obtained in Example 10 had excellent moisture absorption and desorption and has no yellowing. In addition, the fabric obtained from this entangled and mixed yarn had superior water absorption, moisture absorption and desorption, antistatic property while maintaining the touch of polyester. And at the same time the fabric did not have slippy touch when wet and was suitable for comfortable material for clothing and moreover had peach touch.

TABLE 3

| | | | Example 10 | Comparative Example 6 | Comparative Example 7 | Comparative Example 8 | Comparative Example 9 |
|---|---|---|---|---|---|---|---|
| Spinning condition | Weight ratio of yarn blend A/B | | 50/50 | 50/50 | 17/83 | 83/17 | 50/50 |
| | Moisture absorption of polyamide series fiber (34° C. × 90% RH) | | 12.6 | 5.4 | 12.6 | 12.6 | 12.4 |
| | Boiling water shrinkage (%) | Polyamide series fiber | 12.8 | 11.6 | 12.3 | 13.8 | 4.7 |
| | | Polyester fiber | 5.1 | 5.1 | 4.7 | 5.6 | 5.1 |
| Evaluation | Moisture absorption 1 (%) | | 4.4 | 1.8 | 1.5 | 6.9 | 4.3 |
| | Moisture disabsorption 1 (%) | | 4.6 | 1.7 | 1.6 | 7.2 | 4.4 |
| | Moisture absorption 5 (%) | | 4.5 | 1.6 | 1.3 | 7.1 | 4.1 |
| | Moisture disabsorption 5 (%) | | 4.8 | 1.8 | 1.5 | 7.3 | 4.1 |
| | b value | | 1.2 | 1.4 | 0.4 | 2.6 | 1.1 |
| | Water absorption (%) | R | 213.7 | 72.8 | 174.4 | 206.9 | 82.1 |
| | Antistatic property | Half period (sec.) | 9 | 60↑ | 60↑ | 60↑ | 12 |
| | | Friction-charged electrostatic potential (V) | 580 | 4200 | 4100 | 4500 | 680 |
| | Color fastness discoloration/staining (grade) | To light | 4 | 4 | 4 | less than 4 | less than 4 |
| | | To washing | 4–5/4 | 5/4–5 | 5/4–5 | 4/1–2 | 4–5/4–5 |
| | | To perspiration (alkali) | 4–5/4 | 5/4–5 | 5/4–5 | 4–5/2 | 4–5/4–5 |
| | | To rubbing (wet) | 4 | 4 | 4 | 2–3 | 4 |
| | Slippy touch | | Without | Without | Without | With | With |
| | Touch of polyester | | With | With | With | Without | Without |
| | Bulky touch | | With | With | With | Without | With |

Note:
A: Polyamide series fiber,
B: Polyester fiber

Comparative Example 6

The mixture of modified polyethyleneoxide and nylon 6 used for core component in example 10 was replaced by nylon 6. Besides the change by nylon 6 the same process was carried out as in example 10 and comparative fabric was obtained.

Comparative Examples 7 and 8

The fineness of the polyamide series fiber was changed from 50 d/12 to 20 d/4 f (comparative example 7) and to 120 d/24 f (comparative example 8) respectively. At the same time the fineness of the polyester fiber was changed from 50 d/36 f to 100 d/68 f (comparative example 7) and to 25 d/12 f (comparative example 8) respectively. Besides that the same process was carried out as in example 10 and comparative fabrics were obtained.

Comparative Example 9

The boiling water shrinkage of the polyamide series fiber was changed from 12.8% to 4.7% and at the same time dry shrinkage was changed from 6.5% to 2.3% respectively. Besides that the same process was carried out as in example 10 and comparative fabric was obtained.

The evaluation of the entangled and mixed yarn and the fabrics obtained in comparative examples 6 to 9 is shown in table 3.

In the woven fabric in comparative example 6 that did not have modified polyethyleneoxide in core component of polyamide series fiber and in the woven fabric in comparative example 7 with a little amount of polyamide series fiber in entangled and mixed yarn, the touch of polyester was obtained, but they only had poor water absorption, moisture absorption and desorption, and antistatic property. The woven fabric in comparative example 8 with excessive amount of polyamide series fiber in entangled and mixed yarn had superior water absorption and moisture absorption and desorption. The fabric, however, had poor antistatic property and color fastness and did not have touch of polyester and had slippy touch when wet. The woven fabric in comparative example 9 in which the boiling water shrinkage of polyamide series fiber was smaller than the one of polyester fiber had superior moisture absorption and desorption, antistatic property, color fastness. The fabric, however, had poor water absorption and slippy touch when wet and did not have touch of polyester.

Example 11

Polyamide series fiber of 40 d/12 f was obtained by the same method in example 10. The obtained polyamide series fiber had boiling water shrinkage of 12.8%, dry shrinkage of 6.5%.

Polyester fiber of 40 d/48 f was obtained by the same method in example 10. The fiber obtained was treated by heat relaxing process using non-touch heater under the condition of temperature 350° C., relaxing ratio 20% ((delivery speed−takeup speed)/takeup speed×100) and speed of 600 m/minute to have the polyester fiber of example 11. The obtained polyester fiber had boiling water shrinkage of 1.6% and dry shrinkage of −3.4%.

The polyamide series fiber and polyester fiber according the method mentioned above were entangled by air using Interlacer-JD-1 manufactured by Dupont Chemical Co., under the condition of yarn speed of 600 m/minute, air pressure of 3 kg/cm$^2$ and over-feed ratio of 2.0%, and the entangled and mixed yarn of the present invention was obtained. The number of intermingle was of the obtained entangled and mixed yarn 60/m.

In the next step woven fabric was obtained using the entangled and mixed yarn by the same method in example 10.

The evaluation of the entangled and mixed yarn and the woven fabric obtained is shown in table 4.

Example 12

Polyester fiber of 40 d/12 f with boiling water shrinkage of 1.9% and dry shrinkage of −2.5% was used. Besides this the same process was carried out as in example 11 to obtain entangled and mixed yarn and woven fabric.

The evaluation of the entangled and mixed yarn and the woven fabric obtained is shown in table 4.

Example 13

The modified polyethyleneoxide obtained in example 10 (water absorption 35 g/g, melt viscosity 4000 poise) was used as core component, and nylon 6 having relative viscosity 2.6 which was measured under the condition of concentration 0.5 g/dl in m-creosol solvent and temperature of 20° C. was used as sheath component. And sheath core type compound fiber with core component/sheath component weight ratio of 20/80 was melt spun. In the spinning process using 12 holes of a nozzle, the polymer was melt spun at 255° C. The yarn was then cooled by air stream of 18° C., oiled and wound at 1300 m/minute. The yarn then was drawn at drawing ratio of 3.0 to obtain sheath core type compound fiber of 50 d/12 f.

This polyamide series fiber had boiling water shrinkage of 15.8%, dry shrinkage of 7.1%.

The polyamide series fiber obtained above and polyester fiber obtained in Example 11 was air interlaced using Interlacer JD-1 manufactured by Dupont Chemical Co., under the condition of yarn speed of 600/minute, air pressure of 1 Kg/cm$^2$ and over feed ratio of 2.0%, and the entangled and mixed yarn of the present invention is obtained. The number of intermingle the obtained entangled and mixed yarn was 54/m.

A plane woven fabric of the present invention was obtained by the same method as in example 10 using this entangled and mixed yarn.

The evaluation results of the entangled and mixed yarn and the woven fabric obtained are shown in table 4.

Comparative Example 10

Polyester fiber with boiling water shrinkage of 15.3% and dry shrinkage of 14.3% was used. Besides this the same process was carried out as in example 11 to obtain comparative woven fabric.

Comparative Example 11

Two of the polyamide series fiber used in example 11 and polyester fiber of 20/16 f were used and entangled and mixed yarn and woven fabric were obtained by the same method as in example 11.

Comparative Example 12

Polyamide series fiber used in example 11 and polyester fiber of 180 d/48 f were used and entangled and mixed yarn was obtained using the same method as in example 11.

Comparative plane woven fabric with warp yarn density of 80/2.54 cm and weft yarn density of 60/2.54 cm was obtained using the same method as in example 11.

The evaluation of the entangled and mixed yarn and the woven fabric obtained in comparative examples 10 to 12 is shown together in table 4.

TABLE 4

| | | | Example 11 | Example 12 | Example 13 | Comparative Example 10 | Comparative Example 11 | Comparative Example 12 |
|---|---|---|---|---|---|---|---|---|
| Spinning condition | Weight ratio of yarn blend A/B | | 45/55 | 50/50 | 50/50 | 50/50 | 83/17 | 17/83 |
| | Moisture absorption of polyamide series fiber (34° C. × 90% RH) | | 12.6 | 12.6 | 14.6 | 12.6 | 12.6 | 12.6 |
| | Single filament fineness of polyester fiber d | | 1.0 | 3.3 | 1.0 | 0.83 | 2.5 | 2.9 |
| | Boiling water shrinkage (%) | Polyamide series fiber | 12.8 | 12.8 | 15.8 | 12.8 | 12.8 | 12.8 |
| | | Polyester fiber | 1.6 | 1.9 | 5.1 | 15.3 | 2.6 | 2.1 |
| | Dry shrinkage (%) | Polyamide series fiber | 6.5 | 6.5 | 7.1 | 6.5 | 6.5 | 6.5 |
| | | Polyester fiber | −3.4 | −2.5 | −3.1 | 14.3 | −0.5 | −1.8 |
| Evaluation | Moisture absorption 1 (%) | | 4.0 | 4.4 | 5.0 | 4.2 | 7.3 | 1.4 |
| | Moisture disabsorption 1 (%) | | 4.2 | 4.6 | 5.2 | 4.4 | 7.6 | 1.5 |
| | Moisture absorption 5 (%) | | 3.9 | 4.5 | 4.9 | 4.3 | 7.1 | 1.4 |
| | Moisture disabsorption 5 (%) | | 4.3 | 4.8 | 5.3 | 4.5 | 1.7 | 1.5 |
| | b value | | 1.6 | 1.4 | 1.5 | 2.1 | 1.8 | 0.8 |
| | Water absorption (%) | R | 235 | 180 | 257 | 195 | 160 | 145 |

TABLE 4-continued

| | | Example 11 | Example 12 | Example 13 | Comparative Example 10 | Comparative Example 11 | Comparative Example 12 |
|---|---|---|---|---|---|---|---|
| Antistatic property | Half period (sec.) | 11 | 10 | 8 | 12 | 29 | 60↑ |
| | Friction-charged electrostatic potential (V) | 610 | 590 | 520 | 700 | 2300 | 3900 |
| Color fastness discoloration/ staining (grade) | To light | 4 | 4 | 4 | 4 | 4 | 4 |
| | To washing | 5/4 | 4–5/5 | 4–5/4 | 4/3–4 | 4/3–4 | 4–5/5 |
| | To perspiration (alkali) | 4–5/4 | 4–5/4 | 4–5/4 | 4/2–3 | 4/2–3 | 5/4–5 |
| | To rubbing (wet) | 4–5 | 4–5 | 4 | 3–4 | 3–4 | 4–5 |
| Slippy touch | | Without | Without | Without | With | With | Without |
| Touch of polyester | | With | With | With | With | Without | With |
| Bulky touch | | With | With | With | Without | Without | With |

Note:
A: Polyamide series fiber,
B: Polyester fiber

As is apparent in table 4, the entangled and mixed yarn obtained in examples 11 and 12 had superior moisture absorption and desorption and did not have yellowing. And also the woven fabric made of this entangled and mixed yarn had touch of polyester, superior water absorption, moisture absorption and desorption, antistatic property and bulky touch. It did not have slippy touch when wet and was suitable for comfortable material for clothing. Moreover the woven fabric obtained in example 12 had peach touch.

The woven fabric using entangled and mixed yarn in example 13 had touch of polyester, superior water absorption, moisture absorption and desorption and antistatic property. It did not have slippy touch when wet and was suitable for comfortable material for clothing. In addition it had powder touch.

On the other hand, the woven fabric in comparative example 10 had excellent water absorption and moisture absorption and desorption. In this fabric, however, touch of polyester could not be obtained because of the larger boiling water shrinkage of the polyamide series fiber than the one of polyester fiber. In addition the color fastness was poor and no bulky touch was obtained. In the woven fabric in comparative example 11, because the weight ratio of the polyamide series fiber in the entangled and mixed yarn was excessive, although water absorption and moisture absorption and desorption were excellent, antistatic property and color fastness were poor. In addition it did not have touch of polyester or bulky touch and had slippy touch when wet. In the woven fabric in comparative example 12, because the weight ratio of the polyamide series fiber in the entangled and mixed yarn was small, although it gave touch of polyester, water absorption, moisture absorption and desorption and antistatic property were poor.

Example 14

Nylon 6 with relative viscosity of 2.6 was used as sheath component, and the mixture of nylon 6 with relative viscosity of 2.6 and modified polyethyleneoxide with water absorption of 35 g/g and with melt viscosity of 4000 poise ((nylon 6/modified polyethyleneoxide)(weight ratio)=85/15) was used as core component. The sheath core concentric circle type compound fiber with core/sheath weight ratio of 50/50 was melt spun. It was drawn, mechanically crimped and cut into predetermined length to give staple fiber. Modified polyalkylene oxide was obtained as reaction product of polyethyleneoxide with weight average molecular weight of 20000, 1,4-butanediol and dicyclohexylmethane-4,4'-diisocyanate.

In detail the above described polymers were melted separately and melt spun using compound type nozzle under the condition of spinning temperature of 260° C. discharge rate of 1.04 g/minute per each hole. The yarn was cooled by the conventional cooling device and wound at winding speed of 1200 m/minute to give undrawn yarn. The plurality of the obtained undrawn yarn were plied together and heat drawn at 60° C. and at drawing ratio of 2.6. Then after the drawn yarn was treated in the stuffing box to give mechanical crimp with number of crimp of 22/25 mm, it was cut into yarn length of 51 mm to give staple fiber of single filament fineness of 3.0 denier.

In the next step the staple fiber was carded using random carding machine to give web. Then partially heated and pressed adhesion was given to the nonwoven web using heating and pressing embossing machine. Thus nonwoven fabric with weight of 50 g/m$^2$ was obtained.

In the heating and pressing treatment embossing roll, which had projection point area of 0.6 mm$^2$ and point density of 20/cm$^2$ and pressing area rate of 13.2%, and heated smooth faced metal roll was used. Treating temperature, namely the surface temperature of the embossing and smooth faced metal rolls, was set to 190° C.

The moisture absorption and desorption, b value, tensile strength and bending resistance etc. of the yarn and the nonwoven fabric obtained are shown in table 5.

TABLE 5

| | | | Example 14 | Example 15 | Example 16 | Example 17 | Example 18 | Example 19 | Example 20 | Comparative Example 13 | Comparative Example 14 | Comparative Example 15 | Comparative Example 16 | Comparative Example 17 |
|---|---|---|---|---|---|---|---|---|---|---|---|---|---|---|
| Manufacturing condition | Core component | Blended material | N6/PAO | N6/PAO | N6/PAO | N6/PAO | N6/PAO | N6/PAO | N6/PAO | N6/PAO | N6/PAO | N6/PAO* | N6/PAO | N6/PAO |
| | | Blending ratio | 85/15 | 70/30 | 70/30 | 90/10 | 40/60 | 70/30 | 90/10 | 95/5 | 30/70 | 85/15 | 85/15 | 85/15 |
| | | PAO melt viscosity (poise) | 4000 | 4000 | 4000 | 4000 | 4000 | 4000 | 4000 | 4000 | 4000 | 5000 | 600 | 35000 |
| | Sheath component | | N6 | N6 | N6 | N6 | N6 | N6 | N6 | N6 | N6 | N6 | N6 | N6 |
| | Method of web manufacturing | | EB | EB | TT | TT | TT | WJ | WJ | EB | EB | EB | EB | EB |
| Evaluation | Moisture absorption 1 (%) | | 5.6 | 11.2 | 10.9 | 4.0 | 18.4 | 9.2 | 3.8 | 1.8 | — | 5.8 | 5.4 | — |
| | Moisture disabsorption 1 (%) | | 6.1 | 12.1 | 11.8 | 4.2 | 19.6 | 9.6 | 4.1 | 1.7 | — | 6.3 | 5.9 | — |
| | Moisture absorption 5 (%) | | 5.2 | 11.6 | 11.2 | 3.9 | 18.5 | 9.1 | 3.6 | 1.7 | — | 5.6 | 5.1 | — |
| | Moisture disabsorption 5 (%) | | 5.9 | 12.0 | 11.9 | 4.3 | 19.2 | 9.7 | 4.3 | 1.7 | — | 6.1 | 5.7 | — |
| | b value | | 1.4 | 1.9 | 2.1 | 0.9 | 3.6 | 2.2 | 1.1 | 0.9 | — | 7.8 | 2.3 | — |
| | PAO concentration in the fiber (wt %) | | 7.5 | 15.0 | 15.0 | 5.0 | 30.0 | 15.0 | 5.0 | 2.5 | 35.0 | 7.5 | 7.5 | 7.5 |
| | Tensile strength | Warp (kg/2.5 cm width) | 8.8 | 8.4 | 7.5 | 7.6 | 6.8 | 6.0 | 6.4 | 8.8 | — | 8.7 | 3.2 | — |
| | | Weft (kg/2.5 cm width) | 5.9 | 5.7 | 5.8 | 6.1 | 5.5 | 4.9 | 5.1 | 6.0 | — | 5.8 | 2.1 | — |
| | Bending resistance (g) | | 98 | 86 | 32 | 36 | 24 | 25 | 28 | 87 | — | 95 | 76 | — |

Note:
N6: Nylon 6,
PAO: Modified polyalkylene oxide,
*Using symmetric aromatic isocyanate compounds
EB: Embossing,
TT: Thermal adhesion treatment,
WJ: High pressure liquid jet treatment

Example 15

From example 14, the blending ratio of nylon 6 and modified polyalkylene oxide in core component of fiber was changed as is shown in table 5. Besides this the same method as in example 1 was carried out to obtain nonwoven fabric.

Moisture absorption and desorption, b value, tensile strength and bending resistance of the fiber obtained and the nonwoven fabrics are shown in table 5.

Example 16

The staple fiber obtained by the same method as in example 15 was carded using carding machine and web was obtained. The obtained web was heat-treated at 235 degree Calculus using suction drum dryer for 1 minute. There occurred welding between the single fibers and nonwoven fabric was obtained.

Moisture absorption and desorption, b value, tensile strength, bending resistance of obtained fiber and nonwoven fabric are shown in table 5.

Examples 17 and 18

In example 14 blending ratio in core component of nylon 6 and modified polyalkylene oxide was changed.

Besides this the same method as in example 16 was carried out to obtain nonwoven fabric.

Moisture absorption and desorption, b value, tensile strength and bending resistance of the obtained fiber and the nonwoven fabrics are shown in table 5.

Example 19

The staple fiber obtained in example 15 was carded using a random carding machine and web was obtained. This nonwoven web was then arranged on the metal gauze of 70 mesh moving at speed of 20 m/minute and was treated by high pressure liquid jet. Excessive water was removed from the processed web using mangle roll, and the web then was dried using hot air dryer. Nonwoven fabric with weight of 50 g/m$^2$in which component fibers were three dimensionally entangled together was obtained.

In this high pressure liquid jet treatment, high pressure columnar water jet machine, in which hole of 0.1 mm diameter are arranged in hole distance of 0.6 mm in single row, was used. Columnar water jet was given from the height of 50 mm in two steps. In the first step, the pressure of water jet was 30 kg/cm$^2$ G and in the second step 70 kg/cm$^2$ G. In the second step after the jet was given from the front side 4 times the web was then turned around and the jet was given from the back side 5 times. The processed web was then dried at 85° C.

Moisture absorption and desorption, b value, tensile strength, bending resistance of the obtained fiber and the nonwoven fabric are shown in table 5.

Example 20

From example 19, the blending ratio of nylon 6 and modified polyalkylene oxide in the core component was changed as is shown in table 5. And besides this the same method as in example 19 was carried out to obtain nonwoven fabric.

Moisture absorption and desorption, b value, tensile strength and bending resistance of the obtained fiber and the nonwoven fabrics are shown in table 5.

Comparative Example 13

From example 14, blending ratio of nylon 6 and modified polyalkylene oxide in the core component of the fiber was set at ((nylon 6/modified polyalkylene oxide)=95/5 by weight ratio. Accordingly this means that the content of modified polyalkylene oxide in the fiber is 2.5% by weight. And besides this the same method as in example 14 was carried out to obtain nonwoven fabric.

Moisture absorption and desorption, b value, tensile strength and bending resistance of the obtained fiber and the nonwoven fabrics are shown in table 5.

Comparative Example 14

From example 14, blending ratio of nylon 6 and modified polyalkylene oxide in the core component of the fiber was set at (nylon 6/modified polyalkylene oxide)=30/70 by weight ratio. Accordingly this means that the content of modified polyalkylene oxide in the fiber is 35.0% by weight. And besides this the manufacturing of non woven fabric was attempted by the same method as in example 14.

The result is shown in table 5.

Comparative Example 15

From the method in example 14, the modified polyalkylene oxide used for the core component was obtained as the reaction product of polyethyleneoxide of weight average molecular weight of 20000, 1,4-butanediol and 4,4'-diphenylmethane diisocyanate as symmetric aromatic isocyanate compound. The modified polyalkylene oxide thus obtained with water absorption of 32 g/g and melt viscosity of 5000 poise was used. And besides this the same method as in example 14 was carried out to obtain nonwoven fabric.

Moisture absorption and desorption, b value, tensile strength and bending resistance of the obtained fiber and the nonwoven fabrics are shown in table 5.

Comparative Example 16

In the method as in example 14, the modified polyalkylene oxide used for the core component was obtained as the reaction product of 25% by weight of polyethyleneoxide with weight average molecular weight of 20000, 75% by weight of copolymerized ethyleneoxide/propyleneoxide (mole ratio at 80/20) with weight average molecular weight of 15000, 1,4-butanediol and dicyclehexylmethane-4,4'-diisocyanate. The modified polyalkylene oxide thus obtained with water absorption of 43 g/g and melt viscosity of 600 poise was used. And besides this the same method as in example 14 was carried out to obtain nonwoven fabric.

Moisture absorption and desorption, b value, tensile strength and bending resistance of the obtained fiber and the nonwoven fabrics are shown in table 5.

Comparative Example 17

In the method as in example 14, the modified polyalkylene oxide for the core component was obtained as the reaction product of the mixture of 50% by weight of polyethyleneoxide with weight average molecular weight of 11000 and 50% by weight of polypropyleneoxide with weight average molecular weight of 4000, 1,4-butanediol and dicyclohexylmethane-4,4'-diisocyanate. The modified polyalkylene oxide thus obtained with water absorption of 30 g/g and melt viscosity of 35000 poise was used. And besides this the same method as in example 14 was carried out to obtain nonwoven fabric.

The result is shown in table 5.

All the nonwoven fabrics obtained in examples 14 to 20 had the sheath component of polyamide and the core component of the mixture of polyamide and modified polyalkylene oxide as the component staple fiber. The modified polyalkylene oxide used in the core component was solvent soluble polymer which had melt viscosity of 1000 to 20000 poise under the weight of 50 kg/cm$^2$ at 170° C. and the weight ratio in the whole fiber was in the range of 5 to 30% by weight. Therefore the nonwoven fabric thus obtained had high mechanical property such as tensile strength and excellent moisture absorption and desorption. And because the modified polyalkylene oxide was the reaction product of polyalkylene oxide, polyol and symmetric aliphatic isocyanate compound, the nonwoven fabric obtained had excellent weather resistance.

On the contrary in the nonwoven fabric obtained in comparative example 13 the ratio of modified polyalkylene oxide in the whole fiber was small and the nonwoven fabric had poor moisture absorption and desorption. In comparative example 14 because the ratio of modified polyalkylene oxide in the whole fiber was excessive, staple fiber could not be obtained because of the poor fiber-forming ability. In the nonwoven fabric obtained in the comparative example 15 the modified polyalkylene oxide using symmetric aromatic isocyanate compound was adopted, and therefore the b value of the component fiber was out of the range of the present invention resulting in yellowing. In the nonwoven fabric the excessively low melt viscosity of the modified polyalkylene oxide used in the fabric obtained in comparative example 16 resulted in inferior fiber tensile strength, and as a result the fabric had low tensile strength having poor practical use. In comparative example 17 staple fiber could not be obtained because of poor fiber-forming ability caused by the excessively high melt viscosity of the modified polyalkylene oxide.

Example 21

Nylon 6 with relative viscosity of 2.6 as the sheath component, the modified polyalkylene oxide used in the example 14 as the only core component in core/sheath weight ratio of 7.5/92.5 (the ratio of modified polyalkylene oxide in the whole fiber of 7.5% by weight) were used to be melt spun to obtain concentric circle sheath core type compound fiber. Staple fiber nonwoven fabric was obtained.

In detail, after the above described nylon 6 was melted at 250° C. and the modified polyalkylene oxide was melted at 150° C., they were melt spun using compound type nozzle at 260° C. Then the same method as in example 14 was carried out to obtain nonwoven fabric.

Moisture absorption and desorption, b value, tensile strength and bending resistance of the obtained fiber and the nonwoven fabrics are shown in table 6.

TABLE 6

| | | | Example 21 | Example 22 | Example 23 | Example 24 | Example 25 | Example 26 | Example 27 | Comparative Example 18 | Comparative Example 19 | Comparative Example 20 | Comparative Example 21 | Comparative Example 22 |
|---|---|---|---|---|---|---|---|---|---|---|---|---|---|---|
| Manufacturing condition | Core component | Blended material | PAO | PAO | PAO | PAO | PAO | PAO | PAO | PAO | PAO | PAO* | PAO | PAO |
| | | Blending ratio | 100 | 100 | 100 | 100 | 100 | 100 | 100 | 100 | 100 | 100 | 100 | 100 |
| | | PAO melt viscosity (poise) | 4000 | 4000 | 4000 | 4000 | 4000 | 4000 | 4000 | 4000 | 4000 | 5000 | 600 | 35000 |
| | Sheath component | | N6 | N6 | N6 | N6 | N6 | N6 | N6 | N6 | N6 | N6 | N6 | N6 |
| | Method of web manufacturing | | EB | EB | TT | TT | TT | WJ | WJ | EB | EB | EB | EB | EB |
| Evaluation | Moisture absorption 1 (%) | | 6.1 | 9.6 | 9.2 | 3.8 | 18.1 | 9.5 | 3.6 | 1.8 | — | 6.3 | 6.3 | — |
| | Moisture disabsorption 1 (%) | | 6.5 | 10.1 | 9.9 | 4.2 | 19.7 | 9.9 | 3.9 | 2.1 | — | 6.9 | 6.5 | — |
| | Moisture absorption 5 (%) | | 5.9 | 9.8 | 9.4 | 3.6 | 18.3 | 9.7 | 3.8 | 1.7 | — | 6.1 | 6.2 | — |
| | Moisture disabsorption 5 (%) | | 6.3 | 10.4 | 10.1 | 4.0 | 19.5 | 10.1 | 3.9 | 1.9 | — | 6.9 | 6.6 | — |
| | b value | | 1.8 | 2.1 | 1.9 | 1.4 | 2.6 | 2.2 | 1.6 | 0.8 | — | 7.1 | 2.2 | — |
| | PAO concentration in the fiber (wt %) | | 7.5 | 15.0 | 15.0 | 5.0 | 30.0 | 15.0 | 5.0 | 2.5 | 35.0 | 7.5 | 7.5 | 7.5 |
| | Tensile strength | Warp (kg/2.5 cm width) | 9.0 | 8.6 | 7.2 | 7.7 | 6.9 | 6.1 | 6.5 | 9.0 | — | 8.9 | 3.3 | — |
| | | Weft (kg/2.5 cm width) | 6.0 | 5.8 | 5.9 | 6.2 | 5.6 | 5.0 | 5.2 | 6.1 | — | 5.9 | 2.1 | — |
| | Bending resistance (g) | | 100 | 90 | 33 | 37 | 26 | 26 | 29 | 91 | — | 100 | 80 | — |

Note:
N6: Nylon 6,
PAO: Modified polyalkylene oxide,
*Using symmetric aromatic isocyanate compounds
EB: Embossing,
TT: Thermal adhesion treatment,
WJ: High pressure liquid jet treatment

Example 22

From example 21, the core/sheath weight ratio was changed to 15.0/85.0, and the weight ratio of the modified polyalkylene oxide in the whole fiber was also changed to 15% by weight. And besides this the same method as in example 21 was carried out to obtain nonwoven fabric.

Moisture absorption and desorption, b value, tensile strength and bending resistance of the obtained fiber and the nonwoven fabrics are shown in table 6.

Example 23

The staple fiber obtained in the same way as example 22 was carded using carding machine and web was obtained. The nonwoven web obtained was treated by heat using suction drum dryer at 235° C. for 1 minute. And welding occurred between the fiber to give nonwoven fabric.

Moisture absorption and desorption, b value, tensile strength and bending resistance of the obtained fiber and the nonwoven fabrics are shown in table 6.

Examples 24 and 25

From example 23, the core/sheath weight ratio was changed to 5.0/95.0 (the weight ratio of the modified polyalkylene oxide in the whole fiber 5.0% by weight) in example 24, and the core/sheath weight ratio was changed to 30.0/70.0 (the weight ratio of the modified polyalkyleneoxide in the whole fiber 30.0% by weight), in example 25. And besides these above described change the same method as in example 23 was carried out to obtain nonwoven fabric.

Moisture absorption and desorption, b value, tensile strength and bending resistance of the obtained fiber and the nonwoven fabrics are shown in table 6.

Example 26

The staple fiber obtained in example 22 was carded using random carding machine to give web. The nonwoven web then was treated as in example 19 by high pressure liquid jet and then dried to obtain nonwoven fabric with weight of 50 g/m$^2$ in which the component fiber was three dimensionally entangled.

Moisture absorption and desorption, b value, tensile strength and bending resistance of the obtained fiber and the nonwoven fabrics are shown in table 6.

Example 27

In example 26 the core/sheath weight ratio was changed to 5.0/95.0 (the weight ratio of the modified polyalkylene oxide in the whole fiber was also changed to 5.0% by weight.) And besides this the same method as in example 26 was carried out to obtain nonwoven fabric.

Moisture absorption and desorption, b value, tensile strength and bending resistance of the obtained fiber and the nonwoven fabrics are shown in table 6.

Comparative Example 18

From example 21 the core/sheath weight ratio was changed and the weight ratio of the modified polyalkylene oxide in the whole fiber was also changed to 2.5% by weight. And besides this the same method as in example 21 was carried out to obtain nonwoven fabric.

Moisture absorption and desorption, b value, tensile strength and bending resistance of the obtained fiber and the nonwoven fabrics are shown in table 6.

Comparative Example 19

From example 21 the core/sheath weight ratio was changed and the weight ratio of the modified polyalkylene oxide in the whole fiber was also changed to 35.0% by weight. And besides this the same attempt as in example 21 was carried out to manufacture nonwoven fabric.

The result is shown in table 6.

Comparative Example 20

Core component was formed only by the modified polyalkylene oxide used in comparative example 15. And besides this the same method as in example 21 was carried out to obtain nonwoven fabric.

Moisture absorption and desorption, b value, tensile strength and bending resistance of the obtained fiber and the nonwoven fabrics are shown in table 6.

Comparative Example 21

Core component was formed only by the modified polyalkylene oxide used in comparative example 16. And besides this the same method as in example 21 was carried out to obtain nonwoven fabric.

Moisture absorption and desorption, b value, tensile strength and bending resistance of the obtained fiber and the nonwoven fabrics are shown in table 6.

Comparative Example 22

Core component was formed only by the modified polyalkylene oxide used in comparative example 17. And besides this the same attempt as in example 21 was carried out to manufacture nonwoven fabric.

The result is shown by table 6.

The nonwoven fabric obtained in examples 21 to 27, in which the core component consisted of only modified polyalkylene oxide, had excellent mechanical property such as tensile strength, moisture absorption and desorption and weather resistance.

On the other hand the nonwoven fabric obtained in comparative example 18 with small content of modified polyalkylene oxide in the whole fiber had inferior moisture absorption and desorption. And in comparative example 19 the content of modified polyalkylene oxide was excessive in the whole fiber and fiber-forming ability turned to be poor. It was impossible to obtain staple fiber. Because the nonwoven fabric obtained in comparative example 20 used modified polyalkylene oxide made of symmetric aromatic isocyanate compound, the weather resistance proved to be inferior. In the nonwoven fabric obtained in comparative example 21, because the melt viscosity of the modified polyalkylene oxide was excessively low, the tensile strength proved to be low and of no practical use resulted from the inferior tensile strength of the fiber. Because melt viscosity of modified polyalkylene oxide was excessively high, a fiber-forming ability turned bad. And as a result, in comparative example 22, staple fiber could not be obtained.

Example 28

The polyethylene terephthalate with relative viscosity of 1.38 was used as sheath component, and the mixture consisting of polyethylene terephthalate with relative viscosity of 1.38 and modified polyalkylene oxide used in example 14 (the weight ratio of (polyethylene terephthalate/modified polyalkylene oxide)=85/15 by weight) was used as core component. The core/sheath weight ratio was set at 50/50. A concentric circle sheath core type compound fiber was melt spun. The melt spun fiber was drawn, mechanically crimped and cut into predetermined length to obtain staple fiber.

In detail the above described polymers were melted separately and melt spun using compound type nozzle under the condition of spinning temperature of 290° C. and of discharge rate of 1.28 g/minute per each hole. The yarn was cooled by the conventional cooling device and wound at winding speed of 1200 m/minute to give undrawn yarn. Next plurality of the obtained undrawn yarn was folded together, and was drawn at 90° C. and under drawing ratio of 3.2 and was then heat treated at 160° C. The yarn then mechanically crimped with number of crimp 22/25 mm using stuffing box. The crimped yarn was then cut into length of 51 mm to obtain staple fiber of single filament fineness of 3.0 denier.

In the next step the staple fiber was carded using random carding machine to give web. Then partially heated and pressed adhesion was given to the nonwoven web using heating and pressing embossing machine. Thus nonwoven fabric with weight of 50 g/m$^2$ was obtained.

In this heated and pressed adhesion process the same embossing machine was used as in example 14. Processing temperature, that is, the surface temperature of the embossing roll and metal roll was set at 245° C.

Moisture absorption and desorption, b value, tensile strength and bending resistance of the obtained fiber and the nonwoven fabrics are shown in table 7.

TABLE 7

| | | | Example 28 | Example 29 | Example 30 | Example 31 | Example 32 | Example 33 | Example 34 | Comparative Example 23 | Comparative Example 24 | Comparative Example 25 | Comparative Example 26 | Comparative Example 27 |
|---|---|---|---|---|---|---|---|---|---|---|---|---|---|---|
| Manufacturing condition | Core component | Blended material | PET/PAO | PET/PAO | PET/PAO | PET/PAO | PET/PAO | PET/PAO | PET/PAO | PET/PAO | PET/PAO | PET/PAO* | PET/PAO | PET/PAO |
| | | Blending ratio | 85/15 | 70/30 | 70/30 | 90/10 | 40/60 | 70/30 | 90/10 | 95/5 | 30/70 | 85/15 | 85/15 | 85/15 |
| | | PAO melt viscosity (poise) | 4000 | 4000 | 4000 | 4000 | 4000 | 4000 | 4000 | 4000 | 4000 | 5000 | 600 | 35000 |
| | Sheath component | | PET | PET | PET | PET | PET | PET | PET | PET | PET | PET | PET | PET |
| | Method of web manufacturing | | EB | EB | TT | TT | TT | WJ | WJ | EB | EB | EB | EB | EB |

TABLE 7-continued

| | | Example 28 | Example 29 | Example 30 | Example 31 | Example 32 | Example 33 | Example 34 | Comparative Example 23 | Comparative Example 24 | Comparative Example 25 | Comparative Example 26 | Comparative Example 27 |
|---|---|---|---|---|---|---|---|---|---|---|---|---|---|
| Evaluation | Moisture absorption 1 (%) | 3.1 | 5.6 | 5.5 | 2.2 | 10.1 | 5.6 | 2.4 | 1.1 | — | 3.3 | 3.1 | — |
| | Moisture disabsorption 1 (%) | 3.5 | 6.1 | 5.8 | 2.4 | 11.2 | 5.9 | 2.7 | 1.1 | — | 3.6 | 3.3 | — |
| | Moisture absorption 5 (%) | 3.1 | 5.7 | 5.6 | 2.1 | 10.5 | 5.5 | 2.4 | 1.2 | — | 3.3 | 3.1 | — |
| | Moisture disabsorption 5 (%) | 3.4 | 6.1 | 5.9 | 2.4 | 11.4 | 5.8 | 2.9 | 1.1 | — | 3.5 | 3.5 | — |
| | b value | 3.1 | 3.4 | 3.1 | 2.6 | 4.0 | 3.0 | 2.2 | 2.0 | — | 9.6 | 3.6 | — |
| | PAO concentration in the fiber (wt %) | 7.5 | 15.0 | 15.0 | 5.0 | 30.0 | 15.0 | 5.0 | 2.5 | 35.0 | 7.5 | 7.5 | 7.5 |
| | Tensile strength Warp (kg/2.5 cm width) | 14.7 | 14.2 | 9.1 | 9.5 | 8.4 | 7.7 | 8.0 | 14.9 | — | 14.6 | 5.1 | — |
| | Weft (kg/2.5 cm width) | 9.4 | 8.8 | 7.2 | 7.8 | 6.8 | 6.1 | 6.6 | 12.6 | — | 11.8 | 5.9 | — |
| | Bending resistance (g) | 735 | 725 | 51 | 66 | 39 | 40 | 51 | 770 | — | 731 | 690 | — |

Note:
N6: Nylon 6,
PAO: Modified polyalkylene oxide,
*Using symmetric aromatic isocyanate compounds
EB: Embossing,
TT: Thermal adhesion treatment,
WJ: High pressure liquid jet treatment

Example 29

From example 28, the blending ratio of polyethylene terephthalate and modified polyalkylene oxide in the core component was changed as shown in table 7. And besides this the same method as in example 28 was carried out to obtain nonwoven fabric.

Moisture absorption and desorption, b value, tensile strength and bending resistance of the obtained fiber and the nonwoven fabrics are shown in table 7.

Example 30

The same staple fiber obtained as in example 29 was carded using carding machine to obtain web. The nonwoven web obtained was treated by heat using suction drum dryer at 275° C. for 1 minute. And welding occurred between the fiber to give nonwoven fabric.

Moisture absorption and desorption, b value, tensile strength and bending resistance of the obtained fiber and the nonwoven fabrics are shown in table 7.

Examples 31 and 32

In example 30 the blending ratio of polyester and modified polyalkylene oxide was changed as shown in table 7. And besides this the same method as in example 30 was carried out to obtain nonwoven fabric.

Moisture absorption and desorption, b value, tensile strength and bending resistance of the obtained fiber and the nonwoven fabrics are shown in table 7.

Example 33

The staple fiber obtained in example 29 was carded using random carding machine to give web. The nonwoven web then was treated as in example 19 by high pressure liquid jet and then dried to obtain nonwoven fabric with weight of 50 g/m$^2$ in which the component fiber was three dimensionally entangled.

Moisture absorption and desorption, b value, tensile strength and bending resistance of the obtained fiber and the nonwoven fabrics are shown in table 7.

Example 34

From example 33, the blending ratio of polyethylene terephthalate and modified polyalkylene oxide in the core component was changed as shown in table 7. And besides this the same method as in example 33 was carried out to obtain nonwoven fabric.

Moisture absorption and desorption, b value, tensile strength and bending resistance of the obtained fiber and the nonwoven fabrics are shown in table 7.

Comparative Example 23

From example 28, the blending ratio of polyethylene terephthalate and modified polyalkylene oxide in the core component of the fiber was set to (polyethylene terephthalate/modified polyalkylene oxide)=95/5 by weight. Accordingly this means that the content of modified polyalkylene oxide in the fiber is 2.5% by weight. And besides this the same method as in example 28 was carried out to obtain nonwoven fabric.

Moisture absorption and desorption, b value, tensile strength and bending resistance of the obtained fiber and the nonwoven fabrics are shown in table 7.

Comparative Example 24

From example 28, the blending ratio of polyethylene terephthalate and modified polyalkylene oxide in the core component of the fiber was set to (polyethylene terephthalate/modified polyalkylene oxide)=30/70 by weight. Accordingly this means that the content of modified polyalkylene oxide in the fiber is 35.0% by weight. And besides this the same attempt as in example 28 was carried out to obtain nonwoven fabric.

The result is shown in table 7.

Comparative Example 25

From example 28, the modified polyalkylene oxide adopted in comparative example 15 was adopted as modified polyalkylene oxide in the core component. And besides this the same method as in example 28 was carried out to obtain nonwoven fabric.

Moisture absorption and desorption, b value, tensile strength and bending resistance of the obtained fiber and the nonwoven fabrics are shown in table 7.

Comparative Example 26

From example 28, the modified polyalkylene oxide adopted in comparative example 16 was adopted. And besides this the same method as in example 28 was carried out to obtain nonwoven fabric.

Moisture absorption and desorption, b value, tensile strength and bending resistance of the obtained fiber and the nonwoven fabrics are shown in table 7.

Comparative Example 27

From example 28, the modified polyalkylene oxide adopted in comparative example 17 was adopted. And besides this the same method as in example 28 was carried out to obtain nonwoven fabric.

Moisture absorption and desorption, b value, tensile strength and bending resistance of the obtained fiber and the nonwoven fabrics are shown in table 7.

All staple fiber which constituting nonwoven fabric obtained in examples 28 to 34 have polyethylene terephthalate as the sheath component and the mixture of polyethylene terephthalate and modified polyalkylene oxide as the core component. The modified polyalkylene oxide used in the core component was solvent soluble polymer which had melt viscosity of ranging 1000 to 20000 poise under the loading weight of 50 kg/cm$^2$ at 170° C. and the weight ratio in the whole fiber was in the range of 5 to 30% by weight. Therefore the nonwoven fabric thus obtained had excellent mechanical property as tensile strength and excellent moisture absorption and desorption. Because the nonwoven fabric used the modified polyalkylene oxide, which was obtained by reacting polyalkylene oxide, polyol with symmetric aliphatic isocyanate compound, the weather resistance of the nonwoven fabric proved to be excellent.

On the other hand, in the nonwoven fabric obtained in comparative example 23, the weight ratio of the modified polyalkylene oxide in the whole fiber is small, and as a result the moisture absorption and desorption was inferior. In addition in comparative example 24, the weight ratio of the modified polyalkylene oxide in the whole fiber was excessive and fiber-forming ability turned to be bad. And staple fiber could not be obtained. In comparative example 25, because the nonwoven fabric used the modified polyalkylene oxide made of symmetric aromatic isocyanate compound, it had inferior weather resistance. In the nonwoven fabric obtained in comparative example 26, because the melt viscosity of the modified polyalkylene oxide was excessively low, the tensile strength proved to be low and of no practical use resulting from the inferior tensile strength of the fiber. Because melt viscosity of modified polyalkylene oxide was excessively high, fiber-forming ability turned bad. And as a result, in comparative example 27, staple fiber could not be obtained.

Example 35

The polyethylene terephthalate with relative viscosity of 1.38 was used as sheath component, and the modified polyalkylene oxide used in example 14 only was used as the core component. The weight ratio of core/sheath was set at 7.5/92.5 (the weight ratio of modified polyalkylene oxide in the whole fiber was 7.5% by weight). Then a concentric circle sheath core type compound fiber was melt spun to obtain staple fiber nonwoven fabric.

In detail the polyethylene terephthalate was melted at 280° C. and the modified polyalkylene oxide was melted at 150° C. The polymers were melt spun together using compound type nozzle at 290° C. And then the same method as in example 28 was carried out to obtain nonwoven fabric.

Moisture absorption and desorption, b value, tensile strength and bending resistance of the obtained fiber and the nonwoven fabrics are shown in table 8.

TABLE 8

| | | | Example 35 | Example 36 | Example 37 | Example 38 | Example 39 | Example 40 | Example 41 | Comparative Example 28 | Comparative Example 29 | Comparative Example 30 | Comparative Example 31 | Comparative Example 32 |
|---|---|---|---|---|---|---|---|---|---|---|---|---|---|---|
| Manufacturing condition | Core component | Blended material | PAO | PAO | PAO | PAO | PAO | PAO | PAO | PAO | PAO | PAO* | PAO | PAO |
| | | Blending ratio | 100 | 100 | 100 | 100 | 100 | 100 | 100 | 100 | 100 | 100 | 100 | 100 |
| | | PAO melt viscosity (poise) | 4000 | 4000 | 4000 | 4000 | 4000 | 4000 | 4000 | 4000 | 4000 | 5000 | 600 | 35000 |
| | Sheath component | | PET | PET | PET | PET | PET | PET | PET | PET | PET | PET | PET | PET |
| | Method of web manufacturing | | EB | EB | TT | TT | TT | WJ | WJ | EB | EB | EB | EB | EB |
| Evaluation | Moisture absorption 1 (%) | | 3.2 | 5.4 | 5.6 | 2.1 | 9.9 | 5.6 | 2.3 | 0.9 | — | 3.5 | 3.1 | — |
| | Moisture disabsorption 1 (%) | | 3.6 | 5.9 | 6.1 | 2.6 | 10.4 | 5.9 | 2.5 | 1.2 | — | 3.9 | 3.7 | — |
| | Moisture absorption 5 (%) | | 3.2 | 5.4 | 5.4 | 2.1 | 10.1 | 5.4 | 2.3 | 0.9 | — | 3.4 | 3.2 | — |
| | Moisture disabsorption 5 (%) | | 3.5 | 5.7 | 5.9 | 2.3 | 10.4 | 6.1 | 2.7 | 1.1 | — | 3.9 | 3.6 | — |
| | b value | | 3.7 | 4.2 | 4.1 | 2.6 | 4.6 | 4.0 | 2.8 | 1.9 | — | 10.7 | 3.6 | — |
| | PAO concentration in the fiber (wt %) | | 7.5 | 15.0 | 15.0 | 5.0 | 30.0 | 15.0 | 5.0 | 2.5 | 35.0 | 7.5 | 7.5 | 7.5 |

TABLE 8-continued

| | | Example 35 | Example 36 | Example 37 | Example 38 | Example 39 | Example 40 | Example 41 | Comparative Example 28 | Comparative Example 29 | Comparative Example 30 | Comparative Example 31 | Comparative Example 32 |
|---|---|---|---|---|---|---|---|---|---|---|---|---|---|
| Tensile strength | Warp (kg/2.5 cm width) | 15.0 | 14.5 | 9.4 | 9.7 | 8.6 | 7.9 | 8.2 | 15.1 | — | 14.9 | 5.2 | — |
| | Weft (kg/2.5 cm width) | 9.6 | 9.0 | 7.4 | 8.0 | 6.9 | 6.2 | 6.7 | 10.2 | — | 9.6 | 3.4 | — |
| Bending resistance (g) | | 772 | 761 | 54 | 69 | 41 | 42 | 54 | 809 | — | 768 | 725 | — |

Note:
N6: Nylon 6,
PAO: Modified polyalkylene oxide,
*Using symmetric aromatic isocyanate compounds
EB: Embossing,
TT: Thermal adhesion treatment,
WJ: High pressure liquid jet treatment Example 36

From example 35 the core/sheath weight ratio was changed to 15.0/85.0 and the weight ratio of the modified polyalkylene oxide in the whole fiber was changed to 15.0% by weight. And besides this the same method as in example 35 was carried out to obtain nonwoven fabric.

Moisture absorption and desorption, b value, tensile strength and bending resistance of the obtained fiber and the nonwoven fabrics are shown in table 8.

Example 37

The same staple fiber as in example 36 was carded using carding machine to obtain web. The nonwoven web obtained was treated by heat using suction drum dryer at 275° C. for 1 minute. And welding occurred between the fiber to give nonwoven fabric.

Moisture absorption and desorption, b value, tensile strength and bending resistance of the obtained fiber and the nonwoven fabrics are shown in table 8.

Examples 38 and 39

To example 37 changes were made as follows. In example 38, the core/sheath weight ratio was changed to 5.0/95.0 (the weight ratio of the modified polyalkylene oxide in the whole fiber 5.0% by weight). In example 39, the core/sheath weight ratio was changed to 30.0/70.0 (the weight ratio of the modified polyalkylene oxide in the whole fiber 30.0% by weight). And besides these above described changes the same method as in example 37 was carried out to obtain nonwoven fabric.

Moisture absorption and desorption, b value, tensile strength and bending resistance of the obtained fiber and the nonwoven fabrics are shown in table 8.

Example 40

The staple fiber in example 36 was carded using random carding machine to obtain web. The nonwoven web then was treated as in example 19 by high pressure liquid jet and then dried to obtain nonwoven fabric with weight of 50 $g/m^2$in which the component fiber was three dimensionally entangled.

Moisture absorption and desorption, b value, tensile strength and bending resistance of the obtained fiber and the nonwoven fabrics are shown in table 8.

Example 41

From example 40, the core/sheath weight ratio was changed to 5.0/95.0 (the weight ratio of the modified polyalkylene oxide in the whole fiber was 5.0% by weight). And besides this change the same method as in example 40 was carried out to obtain nonwoven fabric.

Moisture absorption and desorption, b value, tensile strength and bending resistance of the obtained fiber and the nonwoven fabrics are shown in table 8.

Comparative Example 28

From example 35 the core/sheath weight ratio was changed and the weight ratio of the modified polyalkylene oxide in the whole fiber was changed to 2.5% by weight. And besides this change the same method as in example 21 was carried out to obtain nonwoven fabric.

Moisture absorption and desorption, b value, tensile strength and bending resistance of the obtained fiber and the nonwoven fabrics are shown in table 8.

Comparative Example 29

From example 35 the core/sheath weight ratio was changed and the weight ratio of the modified polyalkylene oxide in the whole fiber was changed to 35.0% by weight. And besides this change the same method as in example 35 was carried out to obtain nonwoven fabric.

The result is shown in table 8.

Comparative Example 30

Core component was formed only by the modified polyalkylene oxide used in comparative example 15. And besides this change the same method as in example 35 was carried out to obtain nonwoven fabric.

Moisture absorption and desorption, b value, tensile strength and bending resistance of the obtained fiber and the nonwoven fabrics are shown in table 8.

Comparative Example 31

Core component was formed only by the modified polyalkylene oxide used in comparative example 16. And besides this change the same method as in example 35 was carried out to obtain nonwoven fabric.

Moisture absorption and desorption, b value, tensile strength and bending resistance of the obtained fiber and the nonwoven fabrics are shown in table 8.

Comparative Example 32

Core component was formed only by the modified polyalkylene oxide used in comparative example 17. And besides this change the same method as in example 35 was carried out to obtain nonwoven fabric.

The result is shown in table 8.

The nonwoven fabric obtained in examples 35 to 41, in which the core component consisted of only the modified polyalkylene oxide, had excellent mechanical property such as tensile strength, moisture absorption and desorption and weather resistance.

On the other hand the nonwoven fabric obtained in comparative example 28 with small content of the modified polyalkylene oxide in the whole fiber had inferior moisture absorption and desorption. In comparative example 29 the content of the modified polyalkylene oxide was excessive in the whole fiber and fiber-forming ability turned poor. It was impossible to obtain staple fiber. Because the nonwoven fabric in comparative example 30 used the modified polyalkylene oxide made of symmetric aromatic isocyanate compound, the weather resistance proved to be inferior. In the nonwoven fabric obtained in comparative example 31 because the melt viscosity of the modified polyalkylene oxide was excessively low, the tensile strength proved to be low and of no practical use resulted from the inferior tensile strength of the fiber. Because melt viscosity of the modified polyalkylene oxide was too high, fiber-forming ability turned bad. And as a result, in comparative example 32, staple fiber could not be obtained.

Industrial Applicability

The synthetic fiber capable of absorbing and disabsorbing moisture of the present invention is especially suitable for the usage in clothing. And the nonwoven fabric comprising the above mentioned fiber is suitable for the usage in sanitary material, in general necessaries and in industry material.

What is claimed is:

1. A synthetic fiber absorbing and disabsorbing moisture comprising a component absorbing and disabsorbing moisture and a fiber-forming polymer, wherein the component absorbing and disabsorbing moisture is a modified polyalkylene oxide obtained by a reaction of polyalkylene oxides, polyols, and aliphatic diisocyanate compounds, and the synthetic fiber absorbing and disabsorbing moisture has a moisture absorption of 1.5% or more when it is allowed to stand to reach a moisture equilibrium under the circumstance of 25° C.×60%RH and then is allowed to stand for 30 min. under the circumstance of 34° C.×90%RH, a moisture disabsorption of 2% or more when it is allowed to reach a moisture equilibrium under the circumstance of 25° C.×60%RH, and stand for 30 min. under the circumstance of 25° C.×60%RH, and a value of −1 to 5 in terms of b value in the CIE-LAB color system when it is allowed to stand for 30 days.

2. The synthetic fiber absorbing and disabsorbing moisture according to claim 1, wherein the fiber is crimped.

3. The synthetic fiber absorbing and disabsorbing moisture according to claim 1, wherein the aliphatic diisocyanate compound forming the modified polyalkylene oxide is dicyclohexylmethane-4,4'-diisocyanate or 1,6-hexamethylene diisocyanate.

4. The synthetic fiber absorbing and disabsorbing moisture according to claim 1, wherein the modified polyalkylene oxide has a melt viscosity of 1000 to 20000 poise at 170° C. and under a loading weight of 50 kg/cm$^2$.

5. The synthetic fiber absorbing and disabsorbing moisture according to claim 1, wherein the fiber has a structure of a sheath core type compound fiber having the component absorbing and disabsorbing moisture being located in a core portion and the fiber-forming polymer being located in a sheath portion.

6. An entangled and mixed yarn, wherein a first fiber comprising the synthetic fiber absorbing and disabsorbing moisture of claim 1 and a second fiber comprising polyester fiber are entangled together, a weight ratio of said yarn blend is (the first fiber)/(the second fiber)=20/80 to 80/20, and boiling water shrinkage of the first fiber is higher than boiling water shrinkage of the second fiber.

7. The entangled and mixed yarn according to claim 6, wherein the first fiber is a polyamide series fiber including in polyamide the modified polyalkylene oxide.

8. The entangled and mixed yarn according to claim 6, wherein the first fiber is a sheath core type compound fiber having a core component and a sheath component, said core component is formed by the modified polyalkylene oxide obtained by the reaction of polyalkylendoxides, polyols, and aliphatic diisocyanates compounds or a mixture of said modified polyalkylene oxide and polyamide, and said sheath component is formed by polyamide.

9. The entangled and mixed yarn according to any one of claims 6 to 8, wherein the second fiber has single fiber fineness of 1.5 denier or less, the second fiber has dry shrinkage smaller than dry shrinkage of the first fiber, and the dry shrinkage of the second fiber is equal to or less than 2%.

10. The entangled and mixed yarn according to any one of claims 6 to 9, wherein the antistatic property is equal to 1000V or less, water absorption is equal to 150% or more, and moisture absorption is equal to 1.5% or more.

11. Knitted and woven fabrics mainly comprising the synthetic fiber absorbing and disabsorbing moisture according to any one of claims 1 to 5 or mainly comprising the entangled and mixed yarn according to any one of claims 6 to 10.

12. A non-woven fabric composed of staple fiber absorbing and disabsorbing moisture, wherein the non-woven fabric is formed by the sheath core type synthetic fiber absorbing and disabsorbing moisture according to claim 5, a sheath component of the staple fiber is formed by polyamide or by polyester, a ratio in weight of the fiber of the modified polyalkylene oxide in the core component is in a range of 5 to 30% by weight, said non-woven fabric holds a predetermined form through bonding of the sheath component of said synthetic fiber or by three dimensional entanglement among said synthetic fibers.

13. The non-woven fabric composed of staple fiber absorbing and disabsorbing moisture according to claim 12, wherein the core component of the synthetic fiber is formed by a mixture comprising the modified polyalkylene oxide and polyamide or polyester instead of the modified polyalkylene oxide.

14. The non-woven fabric composed of staple fiber absorbing or disabsorbing moisture according to claim 12 or claim 13, wherein the aliphatic diisocyanate constituting the modified polyalkylene oxide in the core component of the synthetic fiber is dicyclohexylmethane-4,4'-diisocyanate or 1,6-hexamethelene diisocyanate.

15. The non-woven fabric composed of staple fiber absorbing and disabsorbing moisture of claim 12 or claim 13 wherein the modified polyalkylene oxide in the core component of the synthetic fiber has a melt viscosity of 1000 to 20000 poise at 170° C. and under loading weight of 50 kg/cm$^2$.

* * * * *